US005847719A

United States Patent [19]

Yamaguchi et al.

[11] Patent Number: 5,847,719

[45] Date of Patent: Dec. 8, 1998

[54] RECORDING APPARATUS

[75] Inventors: Hideki Yamaguchi, Yokohama; Atsushi Noda, Kawasaki; Soichi Hiramatsu, Tokyo; Hiroyuki Inoue, Yokohama; Takashi Nojima, Tokyo; Hitoshi Nakamura, Yokohama; Akira Kida, Yokohama; Hideaki Kawakami, Yokohama; Takeshi Iwasaki, Yokohama, all of Japan

[73] Assignee: Canon Kabushiki Kaisha, Tokyo, Japan

[21] Appl. No.: 602,357

[22] Filed: Feb. 16, 1996

[30] Foreign Application Priority Data

Feb. 21, 1995 [JP] Japan ..... 7-032194
Feb. 23, 1995 [JP] Japan ..... 7-031262

[51] Int. Cl.[6] ..... B41J 13/00

[52] U.S. Cl. ..... 346/134; 347/104

[58] Field of Search ..... 347/104, 107, 347/264; 346/134; 400/605, 636; 271/4.04, 4.09, 10.05, 10.09, 109

[56] References Cited

U.S. PATENT DOCUMENTS

| | | | |
|---|---|---|---|
| 4,168,058 | 9/1979 | Granzow et al. | 271/5 |
| 4,478,402 | 10/1984 | Kane . | |
| 4,535,344 | 8/1985 | Noda | 346/139 D |
| 5,019,839 | 5/1991 | Watanabe et al. | 346/134 |
| 5,225,853 | 7/1993 | Kobayashi et al. | 347/33 |
| 5,291,224 | 3/1994 | Asano et al. | 346/134 |
| 5,358,230 | 10/1994 | Ikemori et al. | 271/114 |
| 5,506,606 | 4/1996 | Saikawa et al. | 346/134 |
| 5,602,571 | 2/1997 | Suda et al. | 346/134 |
| 5,620,174 | 4/1997 | Taniguro et al. | 271/10.12 |

FOREIGN PATENT DOCUMENTS

| | | |
|---|---|---|
| 393 654 | 11/1991 | Austria . |
| 0 659 571 | 6/1995 | European Pat. Off. . |
| 59-057777 | 4/1984 | Japan . |
| 60-112470 | 6/1985 | Japan . |
| WO 81/01134 | 4/1981 | WIPO . |

*Primary Examiner*—Matthew V. Nguyen
*Attorney, Agent, or Firm*—Fitzpatrick, Cella, Harper & Scinto

[57] ABSTRACT

In a recording apparatus, the size and the weight of the apparatus and the number of components are reduced, accumulated tolerance is reduced due to the decrease in the number of components, and the sheet feeding/discharging property, the conveying property, the adjustability of the distance between recording means and a sheet member, and the assembling capability of the apparatus are improved. The apparatus includes a first roller for conveying the sheet member toward a supporting surface, a second roller for grasping the sheet member together with the first roller, a third roller for discharging the sheet member from the supporting surface, and a fourth roller for grasping the sheet member together with the third roller. The apparatus also includes a first case including a carriage, the first roller and the third roller, and a second case including a platen, the second roller and the fourth roller. The second roller is elastically urged toward the first roller, and the fourth roller is elastically urged toward the third roller.

18 Claims, 26 Drawing Sheets

RECORDING APPARATUS

BACKGROUND OF THE INVENTION

1. Field of the Invention

This invention relates to a recording apparatus which includes a conveying rotating member for guiding and discharging a recording medium relative to a recording region where recording is performed on the recording medium by recording means.

2. Description of the Related Art

In a conventional recording apparatus which includes a conveying rotating member for guiding and discharging a recording medium relative to a recording region where recording is performed on the recording medium by recording means, respective components are independently positioned and fixed within a chassis. A description will be provided of an ink-jet recording apparatus, serving as such a conventional recording apparatus, with reference to FIG. 27.

When a plurality of sheets 200 are inserted into the main body of the apparatus from a sheet-feeding port provided in a case (not shown), the leading edges of the sheets 200 are held by a sheet-feeding stack unit 201A provided at a continuous automatic sheet feeding mechanism (hereinafter termed an "ASF") 201 incorporated in the main body, and the right and left leading-edge portions of the sheets 200 are pressed from above by corner pawls 202. In this state, a sheet-feeding roller 203 is rotated to separate the uppermost sheet 200 and feed it to a conveying roller 204, and then the sheet 200 is conveyed by being grasped by pinch rollers 205. The sheet 200 is further conveyed to and discharged by a pair of discharging rollers 206.

In the above-described configuration, all of a sheet-feeding unit (including the sheet-feeding roller 203 and the ASF 201), the conveying roller 204, the pinch rollers 205, and the discharging rollers 206 are independently held on a chassis 207, made of sheet metal, using screws, E-rings or the like.

A carriage, which mounts a recording head (not shown), is also held on the chassis 207 via a carriage guide shaft. In addition, a cap mechanism for stabilizing a discharging operation of the recording head is fixed on the chassis 207 outside a printing region.

In the above-described conventional apparatus, since the sheet-feeding unit, the conveying roller 204, the pinch rollers 205, the discharging rollers 206, the carriage and the cap mechanism are independently provided and are positioned and fixed on the chassis 207 which is made of sheet metal; they are, in most cases, fixed using screws, E-rings or the like.

As a result, the production cost increases due to an increase in accumulated tolerance caused by an increase in the number of components, due to an increase in the number of assembling processes, and due to an increase in the size of the chassis.

An increase in the size of the chassis results in an increase in the weight of the apparatus. The size of the chassis unit increases because the respective units are independent, thereby causing an increase in the size of the apparatus. Such problems are against recent requests for a smaller apparatus, and therefore are important.

Furthermore, since many functions are present in the chassis unit, the assembling capability of the apparatus is very poor.

In addition, since it is difficult to position many functional units with one another within the chassis unit, accuracy in recording, the sheet feeding and discharging properties, the capping capability and the like of the apparatus decrease.

Furthermore, the above-described increase in accumulated tolerance due to an increase in the number of components causes difficulty in optimizing the interval between the recording head and the recording medium in the recording region.

Particularly in the case of an ink-jet recording method, it is known that when using recording paper as a recording medium, a difference occurs in expansion and contraction of fibers due to a difference in the density of ink as ink droplets penetrate into the medium, thereby causing undulated deformation in the recording paper during recording (cockling). In order to prevent contact between such undulated recording paper and the recording head, there have been proposed recording apparatuses in which an adjusting lever for adjusting the interval between the recording head and the recording medium is provided and the operator operates the adjusting lever, and recording apparatuses in which fixing means, such as a heater or the like, for fixing the recording medium is provided in the recording region, and the amplitude of the undulation in the direction of the recording head is suppressed by the fixing means. However, provision of such an adjusting lever or fixing means for preventing contact between the recording medium and the recording head causes an increase in the size of the apparatus and an increase in the cost of the apparatus.

SUMMARY OF THE INVENTION

The present invention has been made in consideration of the above-described problems.

It is an object of the present invention to provide a recording apparatus in which the size and the weight of the apparatus are reduced, the number of components is reduced, and accumulated tolerance is reduced due to the decrease in the number of components, and in which the sheet feeding and discharging property, the conveying property, the adjustability of the distance between recording means and a sheet member, and the assembling capability of the apparatus are improved.

It is another object of the present invention to provide a recording apparatus which can steplessly adjust the distance between a recording head and a sheet member, which is disposed in a recording region, by grasping and conveying the sheet member while urging one of a pair of conveying rotating members for grasping and conveying the recording member to another conveying rotating member.

According to one aspect, the present invention which achieves these objectives relates to a recording apparatus for performing recording on a sheet member disposed in a recording region using a recording head, comprising a first rotating member, disposed at a side downstream of the recording region, for conveying the sheet member while contacting a surface of the recording member not facing the recording head, a second rotating member for grasping the sheet member in cooperation with the first rotating member, and supporting means for supporting the first rotating member so as to be movable in a direction of approaching or separating from the recording head. The supporting means supports the first rotating member by a shaft member having an elastically deformable portion, and transmits a rotating driving force via the elastically deformable portion irrespective of the movement of the first rotating member in the direction of approaching or separating from the recording head.

According to another aspect, the present invention which achieves these objectives relates to a recording apparatus for performing recording on a sheet member disposed in a recording region using a recording head, comprising first rotating members, disposed at a side downstream of the recording region, for conveying the sheet member while contacting a surface of the recording member not facing the recording head, second rotating members for grasping the sheet member in cooperation with the first rotating members, third rotating members, disposed at a side downstream of the first rotating members, for conveying the sheet member while contacting the surface of the recording member not facing the recording head, fourth rotating members for grasping the sheet member in cooperation with the third rotating members, first urging means for urging the first rotating members toward the second rotating members, and second urging means for urging the third rotating members toward the fourth rotating members. The urging force of the second urging means is weaker than the urging force of the first urging means.

According to still another aspect, the present invention which achieves these objectives relates to a recording apparatus for performing recording on a sheet member disposed in a recording region using a recording head, comprising a first unit for holding printing members for performing image formation on the sheet member, and a second unit, facing the first unit, for holding the printing members for performing image formation on the sheet member. The printing members of the second unit are disposed so as to be faceable at positions where they contact the printing members of the first unit when performing image formation. The apparatus also comprises urging means for urging all of the printing members of the first unit toward the second unit.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

Figure 1:
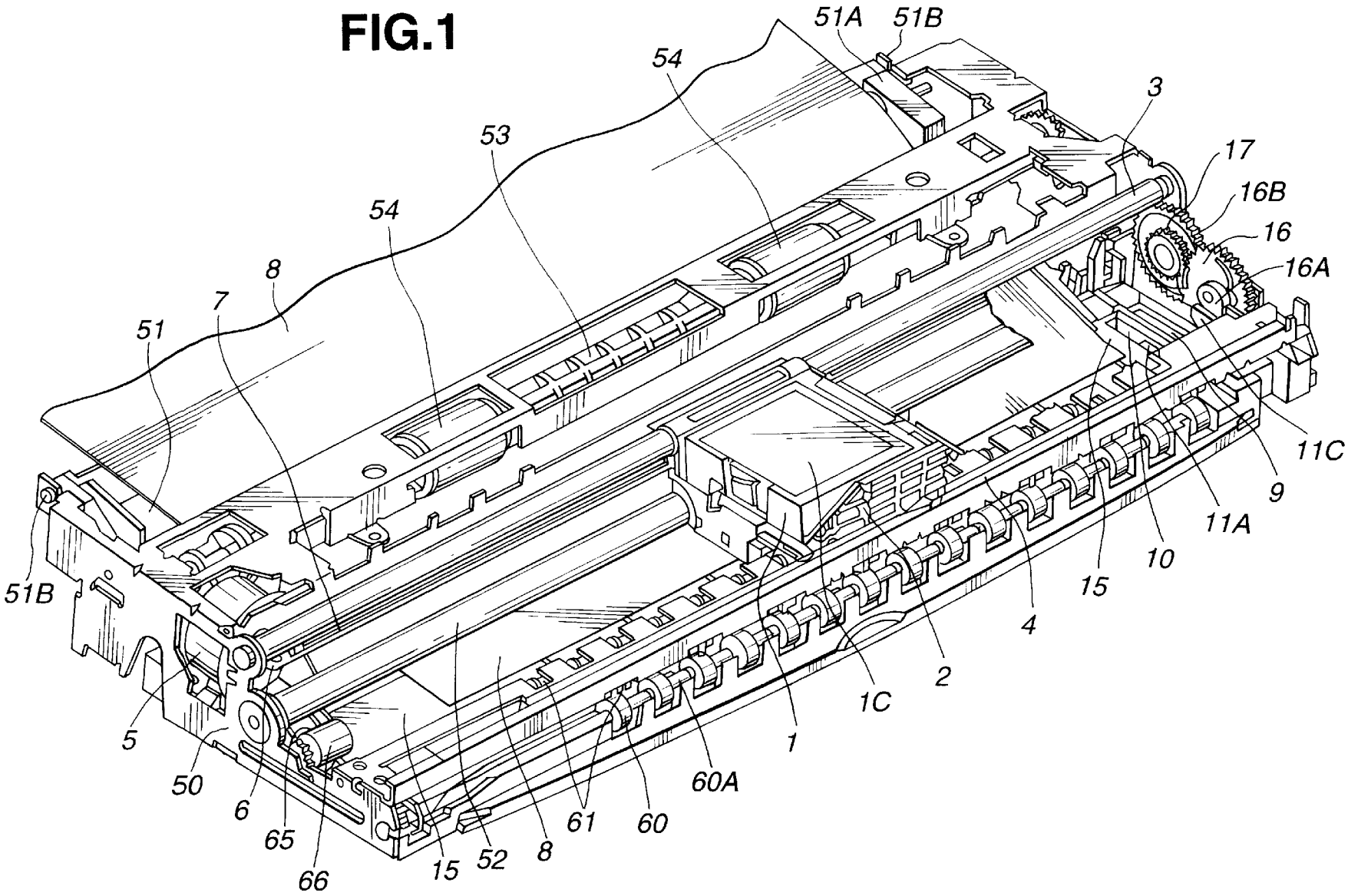
FIG. 1 is a schematic perspective view illustrating a recording apparatus commonly used for first through fourth embodiments of the present invention.

Preferred embodiments of the present invention will now be described in detail with reference to the drawings.

In FIGS. 1 through 4, an ink-jet recording head 1 is mounted on a carriage 2 which is slidable along a guide shaft 3 and a guide rail 4. The carriage 2 is moved by a carriage motor 5 supported on a chassis 50 in a state in which a part of a timing belt 7 wound around a pulley 6 is fixed (not shown) to the carriage 2. The carriage 2 is reciprocated by changing the direction of rotation of the motor 5. The guide shaft 3 and the guide rail 4 are fixed to the chassis 50. The recording head 1 is configured by integrating an ink-jet head element (not shown) having the function of discharging ink with an ink tank 1C for supplying the ink-jet head element with the ink. A recording head capable of performing color recording and a recording head dedicated for performing black recording are prepared, and one of these heads can be detachably mounted on the carriage 2 according to the user's preference. When ink is consumed by recording, only the ink tank 1C can be detachably mounted relative to the recording head 1. The head element discharges ink onto a recording sheet 8, serving as a sheet material, from a plurality of discharging ports, which are disposed in line, in accordance with a signal from a control circuit using thermal energy produced by an electrothermal transducer, such as a heater or the like, or mechanical deformation energy produced by an electromechanical transducer, such as a piezoelectric element or the like.

The recording sheet 8 is guided and discharged by a plurality of conveying rotating members relative to a recording region where recording is performed by the recording head 1.

The recording sheets 8 are set on the upper surface of a pressing plate 51 so that the right edge of the recording sheets 8 are adjusted to the left wall of a releasing lever 51A integrally formed at a right-end portion of the pressing plate 51. The pressing plate 51 is rotatable around a shaft 51B relative to the chassis 50, and is urged by a pressing-plate spring 67 (see FIG. 3) so that pressure is applied to pickup rubber 54. The pressing plate 51 is raised by a cam portion 53A (see FIG. 3) of a feeding-roller shaft 53 in an initial state. Hence, a gap is produced between the pressing plate 51 and the pickup rubber 54, and therefore the recording sheet 8 can be set.

Figure 2:
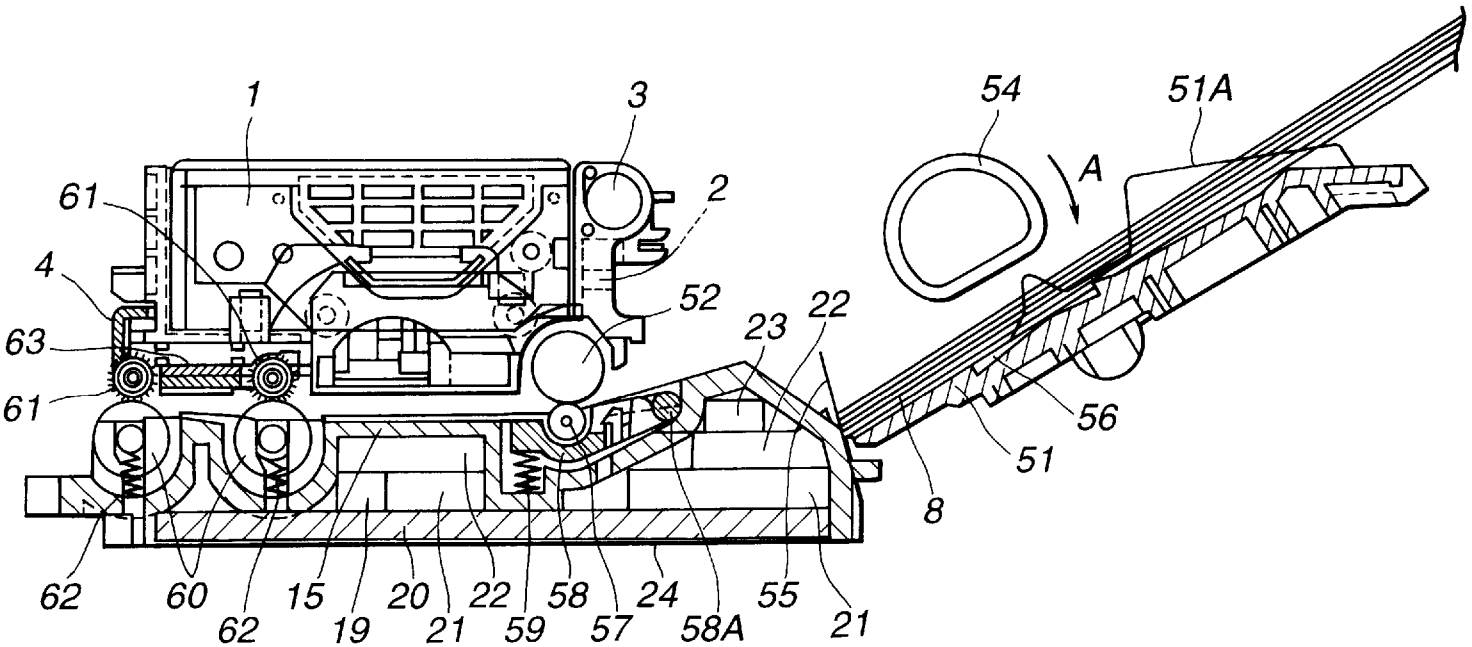
FIGS. 2 and 3 are schematic cross-sectional views of the recording apparatus shown in FIG. 1.

As shown in FIG. 2, the leading edges of the set recording sheets 8 contact and are held by a lower portion of an elastic member 55 whose lower end is fixed to a base 15. Accordingly, a sheet-feeding stack unit is formed by the base 15 and the elastic member 55 whose lower end is fixed to the base 15.

When a sheet-feeding motor (not shown) starts to rotate in response to a feeding command from a controller (not shown), the rotation is transmitted by a gear train (not shown) to rotate the pickup rubber 54 in the direction of an arrow A, whereby the cam portion 53A is disengaged, and the pressing plate 51 is raised by the pressing-plate spring 67. As a result, the recording sheets 8 mounted on the pressing plate 51 are in pressure contact with the pickup rubber 54 provided around the feeding-roller shaft 53.

The pickup rubber 54 having a large coefficient of friction is fixed around the feeding-roller shaft 53 in a state in which the outer diameter of the pickup rubber 54 is larger than the maximum outer diameter of the feeding-roller shaft 53. A separation pad 56, serving as a frictional member for preventing slip of the recording sheet 8, is fixed at a position facing the pickup rubber 54 on the pressing plate 51 (see FIG. 2).

Accordingly, when the feeding-roller shaft 53 further rotates, the recording sheets 8 pushed forward by the frictional force of the pickup rubber 54 bend the elastic member 55 whose lower end is fixed to the base 15, and the uppermost recording sheet 8 is separated and fed by the action of the resistance force of the elastic member 55. Thus, the elastic member 55 fixed to the base 15 serves as separation means. The separated and fed recording sheet 8 is further conveyed to a portion below the carriage 2, i.e., above the base 15, while being grasped by a conveying roller 52, whose both ends are supported on the chassis 50, and a pinch roller 57 provided on the base 15. This portion is generally called a platen portion, where there are provided ribs for guiding the recording sheet 8, ribs for supporting the recording sheet 8 from below when it bends, and the like. A recording region is formed in a space between the recording head 1 and the platen portion.

In order to prevent skew of the recording sheet 8, the leading edge of the recording sheet 8 is positioned by contacting the recording sheet 8 to the conveying roller 52, rotating in a reverse direction, and the pinch roller 57 before the recording sheet 8 is conveyed to a portion below the carriage 2, and thereafter the recording sheet 8 is conveyed to the portion below the carriage 2 by rotating the conveying roller 52 in a forward direction. By driving the carriage motor 5 in this state, the carriage 2 performs scanning in a direction orthogonal to the conveying direction of the recording sheet 8, and ink is discharged from the recording head 1 provided on the carriage 2 in response to a recording command to execute recording on the recording sheet 8.

A description will now be provided of the pinch roller 57 with reference to FIG. 2. The pinch roller 57 is rotatably supported by a pinch-roller holder 58, which is rotatable around a shaft 58A relative to the base 15. A pinch-roller spring 59 is present between the base 15 and the pinch-roller holder 58 in order to press the pinch roller 57 against the conveying roller 52.

Next, a description will be provided of a discharging portion. The recording sheet 8 on which recording has been performed below the carriage 2 (below the recording head 1) is fed by the conveying roller 52 and the pinch roller 57, and reaches discharging rollers 60 and spurs 61. The discharging rollers 60 are integrated with a discharging-roller shaft 60A, and are elastic. The discharging-roller shaft 60A is supported by the base 15. The discharging rollers 60 provided so as to face the corresponding spurs 61, are pressed against the spurs 61 by corresponding discharging-roller springs 62. The spurs 61 are rotatably supported by a spur holder 63, which is fixed to the guide rail 4 fixed to the chassis 50.

The discharging-roller springs 62 are set to a low load, so that the discharging roller side (the discharging-roller shaft 60A) vertically moves in accordance with the thickness of the sheet which depends on the kind of the sheet.

A description will now be provided of an embodiment of the present invention in which by forming an elastic portion in the discharging-roller shaft for discharging the recording sheet and setting a discharging force to a low load so that the discharging-roller side (the discharging-roller shaft) vertically moves in accordance with the thickness of the sheet which depends on the kind of the sheet, the discharging rollers separate from the recording head when undulation caused by cockling is present.

First Embodiment

Figure 4:
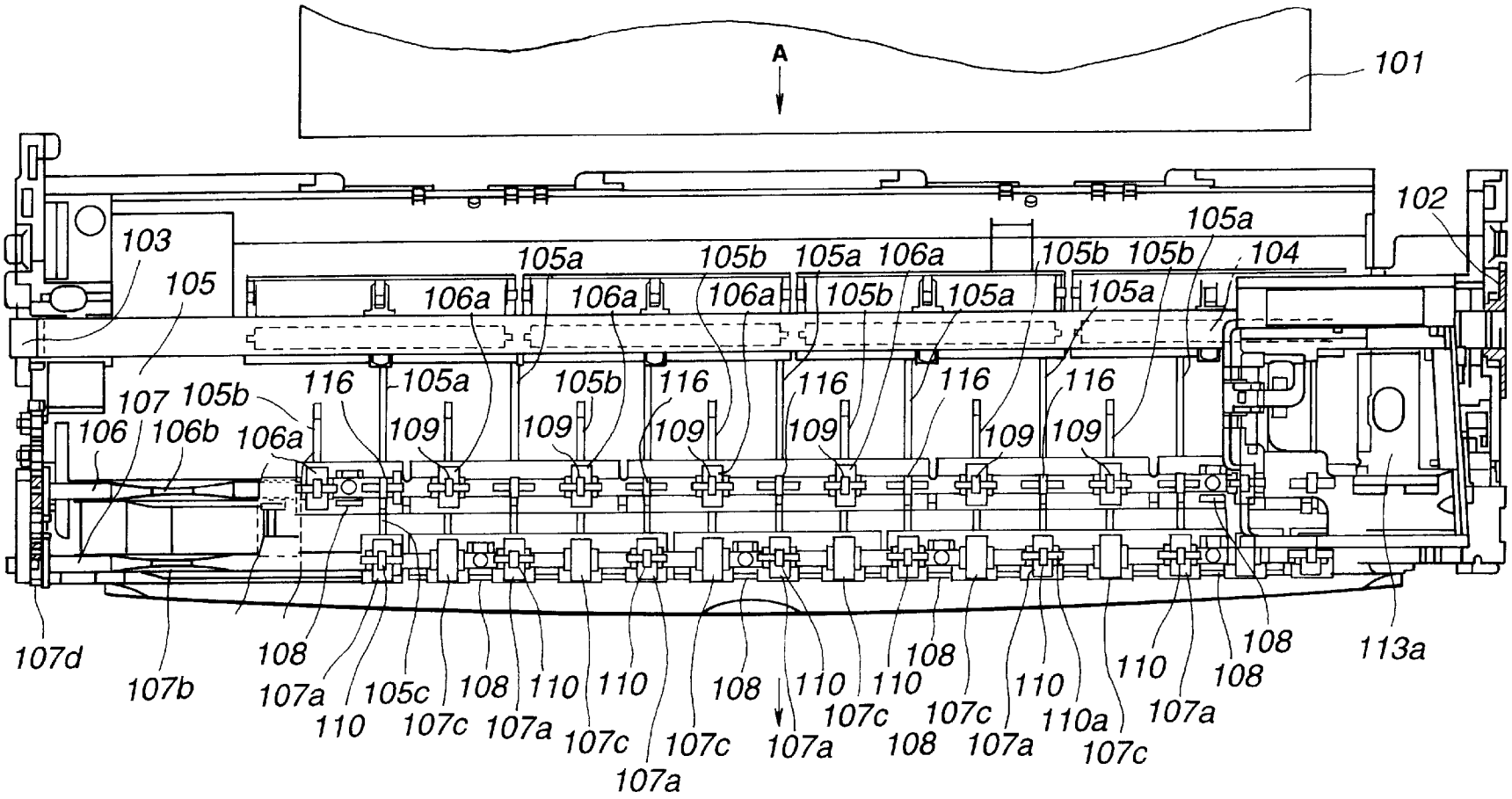
FIG. 4 is a plan view illustrating a first embodiment of the present invention.
Figure 5:
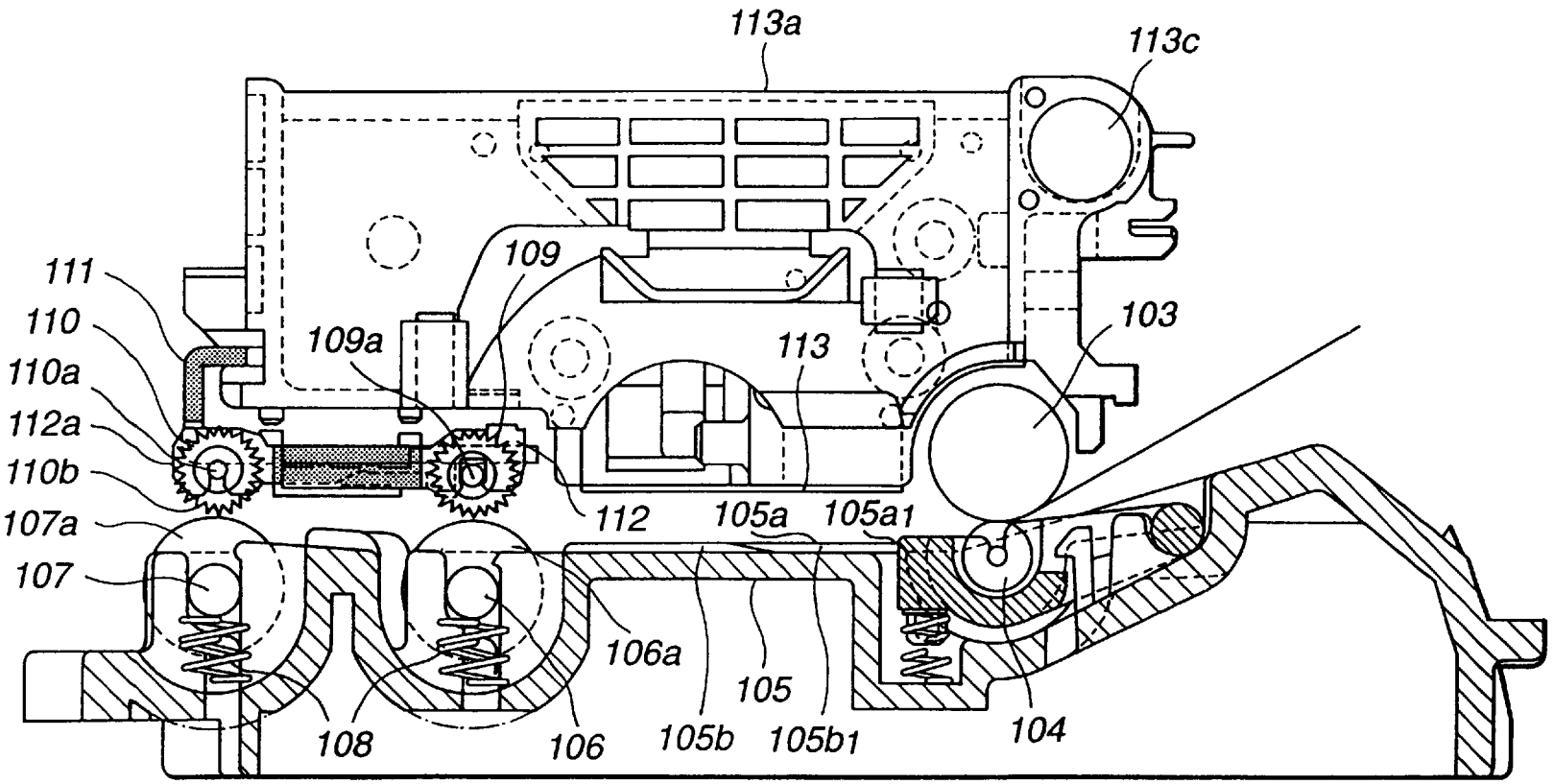
FIG. 5 is a cross-sectional view illustrating the first embodiment.

In FIG. 4, a recording sheet 101 fed by a feeding roller (not shown) in the direction of an arrow A reaches and enters a wedge portion formed by a conveying roller 103, having a conveying gear 102 fixed on the shaft thereof, and pinch rollers 104. A conveying motor (not shown) is driven, whereby the recording sheet 101 is conveyed to a writing-start position by the conveying roller 103, and recording is performed by a recording head 113 which discharges ink droplets in accordance with data from a personal computer or the like. A carriage 113*a* for holding the recording head 113 is supported by a guide shaft 113*c* and a guide rail 111 (see FIG. 5) so as to be slidable in the lateral direction of the recording sheet 101. The leading edge of the recording sheet 101 reaches discharging rollers 106*a,* serving as rotating members, and spurs 109, also serving as rotating members, along ribs 105*a* and 105*b* provided on a platen 105. The ribs 105*a* and 105*b* are disposed at positions on productions from corresponding discharging rollers 107*a,* serving as rotating members, and discharging rollers 106*a,* respectively, in order to prevent contact of respective portions of cockling of the recording sheet 101 (to be described later) to the ribs 105*a* and 105*b,* and rub between the recording head 113 and the recording sheet 101 raised due to strong stiffness caused by cockling.

The ribs 105*a* and 105*b* have different start points $\mathbf{105}a_1$ and $\mathbf{105}b_1$ (see FIG. 5), in order to reduce load at the points $\mathbf{105}a_1$ and $\mathbf{105}b_1$ when the ribs 105*a* and 105*b* contact the recording sheet 101 and the load torque of the conveying motor has the largest value because of the configuration of the path having an angle when a thick recording sheet is conveyed. The distance between the recording head 113 and the recording sheet 101 until the recording sheet 101 reaches the discharging rollers 106*a* is determined by the height of the ribs 105*a* and 105*b*. The heights of the ribs 105*a* and 105*b* are set to such values that rub with the recording head 113 and the like, and jam of the recording sheet 101 are not produced due to warp of the recording sheet 101 and warp caused by a recording pattern.

The leading edge of the recording sheet 101 depresses a discharging-roller shaft 106 and the discharging rollers 106*a* urged by compression springs 108 in the direction of the thickness, i.e., a direction substantially orthogonal to the conveying direction of the sheet, reaches the discharging rollers 107*a* and spurs 110 while contacting ribs 105*c,* and is discharged while depressing a discharging-roller shaft 107 and the discharging rollers 107*a*. Each of the spurs 109 and 110 is formed by etching a thin stainless-steel plate in the shape of a gear, and has a plurality of radially formed teeth 110*b* which are in point contact or line contact with the sheet 101 at very small areas. The angle of the distal end of each tooth 110*b* is about 25°–30°. The spurs 109 and 110 are mounted on spur shafts 109*a* and 110*a,* respectively, which are insertion formed using resin. The spur shaft 109*a* is slidably rotated by being urged against the plane of the guide rail 111, made of a metal plate, for guiding the carriage 113*a* by the discharging rollers 106*a* via compression springs 108. Accordingly, the distance between the recording sheet 101 and the recording head 113 is determined by the values of accuracy in respective components, and an adjusting mechanism, such as an adjusting lever or the like, for adjusting the distance between the recording sheet 101 and the recording head 113 is absent. The spur shaft 110*a* is slidably rotated in a bearing unit 112*a* of a spur holder 112 made of resin.

The contact points between the spurs 110 and the recording sheet 101 are set to be higher than the contact points between the spurs 109 and the recording sheet 101. In order to prevent rub with the recording head 113 due to a raise caused by the weight of a relatively heavy post card, a thick envelope or the like, or due to a curl of the recording sheet 101, two sets of a discharging-roller train and a spur train are provided.

Figure 6:
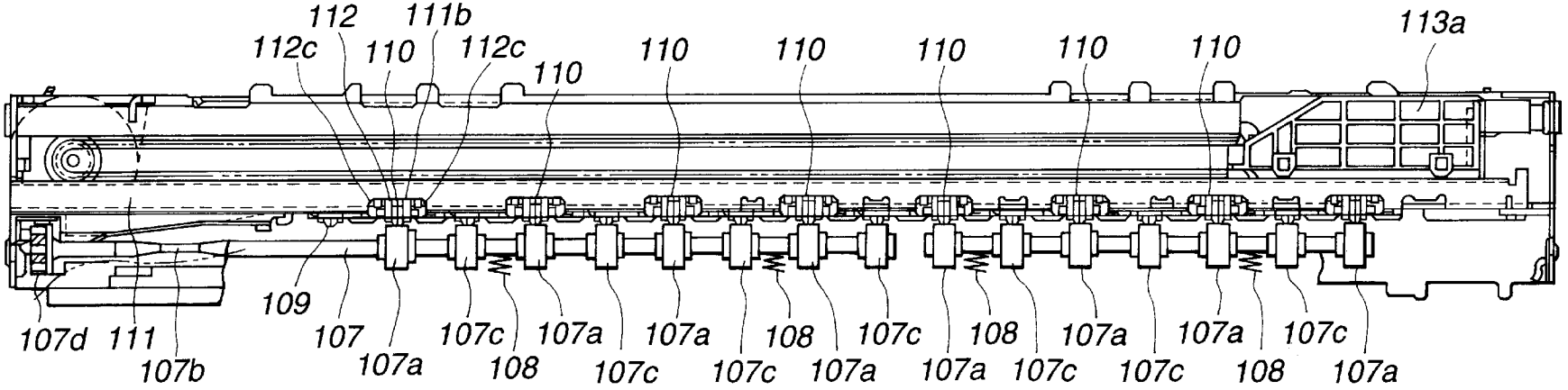
FIG. 6 is a front view illustrating the first embodiment.

FIG. 6 is a front view of the recording apparatus as seen from the discharging direction. An elastic portion 107*b* having a small diameter for allowing elastic deformation is formed on the discharging-roller shaft 107, made of resin, urged toward the spurs 110 by the compression springs 108. A driving force is transmitted to the shaft 107 via a gear 107*d*. Similarly, an elastic portion 106*b* is formed in the discharging-roller shaft 106. A driving force is transmitted to the shaft 106 via a gear 106*d*.

Figure 7:
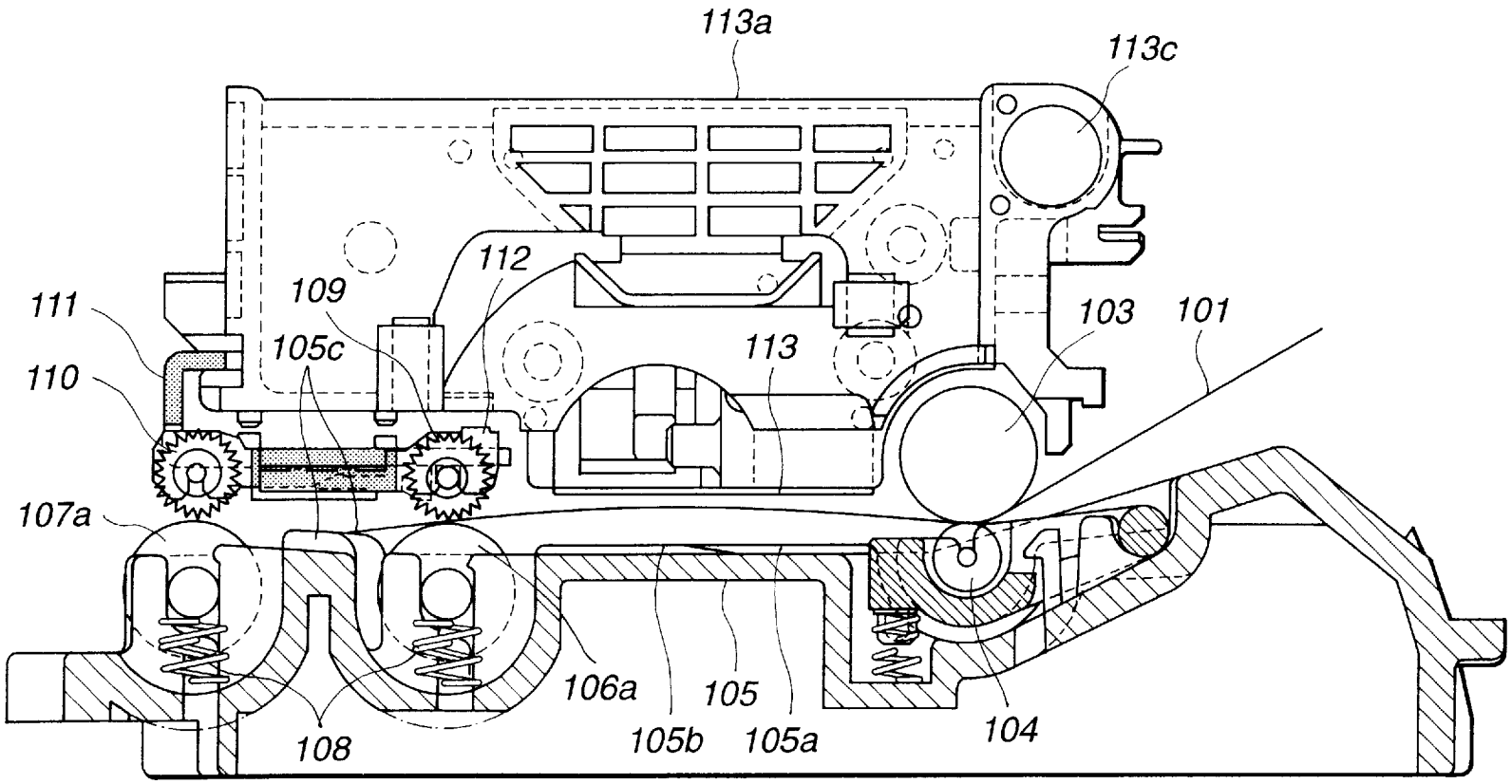
FIG. 7 is a cross-sectional view illustrating the first embodiment.

FIG. 7 illustrates a state in which recording has been performed from the leading edge of the recording sheet 101, which reaches ribs 105*c* provided between the dicharging rollers 106*a* and 107*a*. Curl of the leading edge of the recording sheet 101 is grown toward the second surface of the recording sheet 101 caused by recording.

Figure 8:
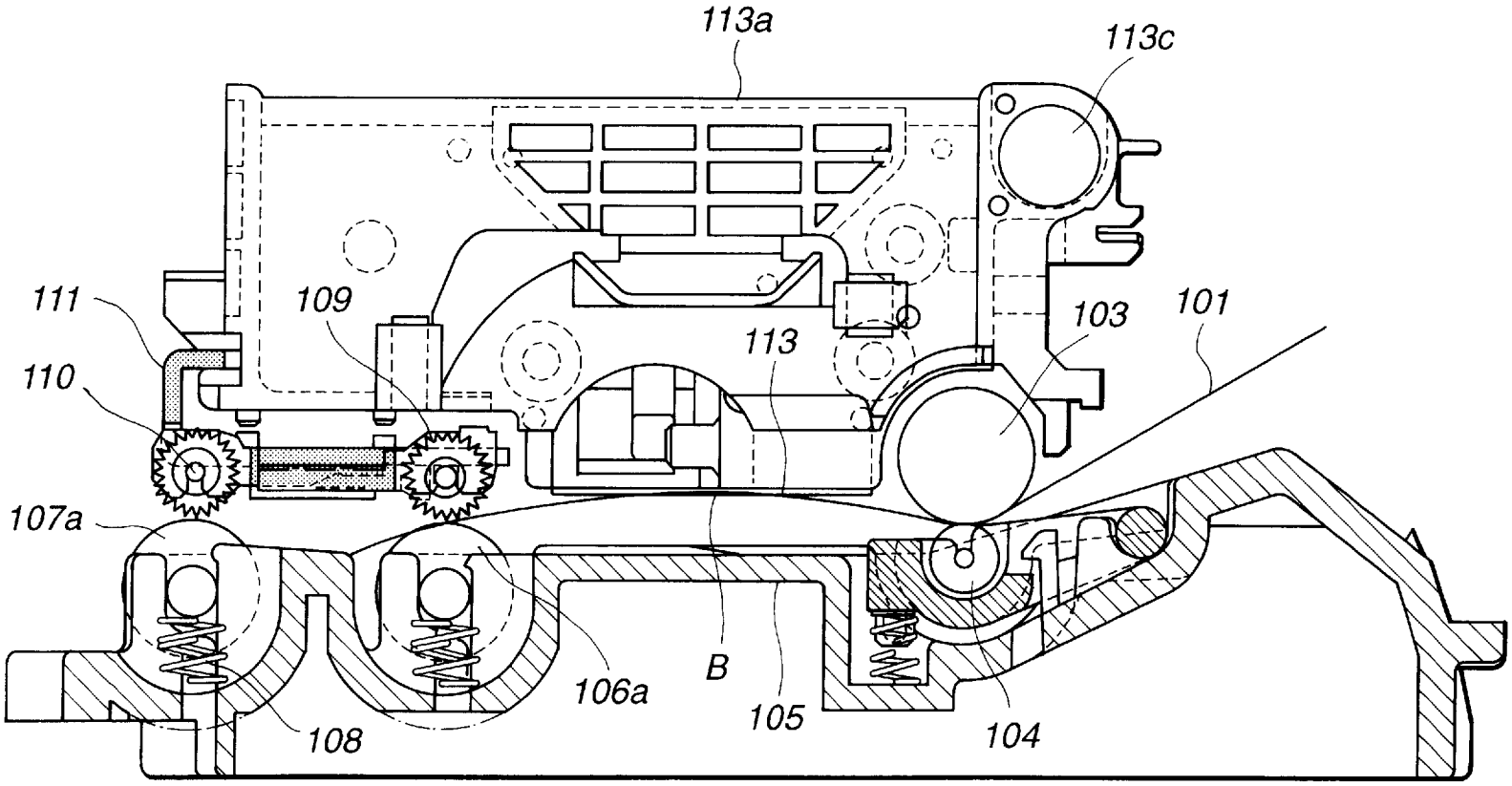
FIG. 8 is a cross-sectional view when a platen 5 does not have ribs.
Figure 9:
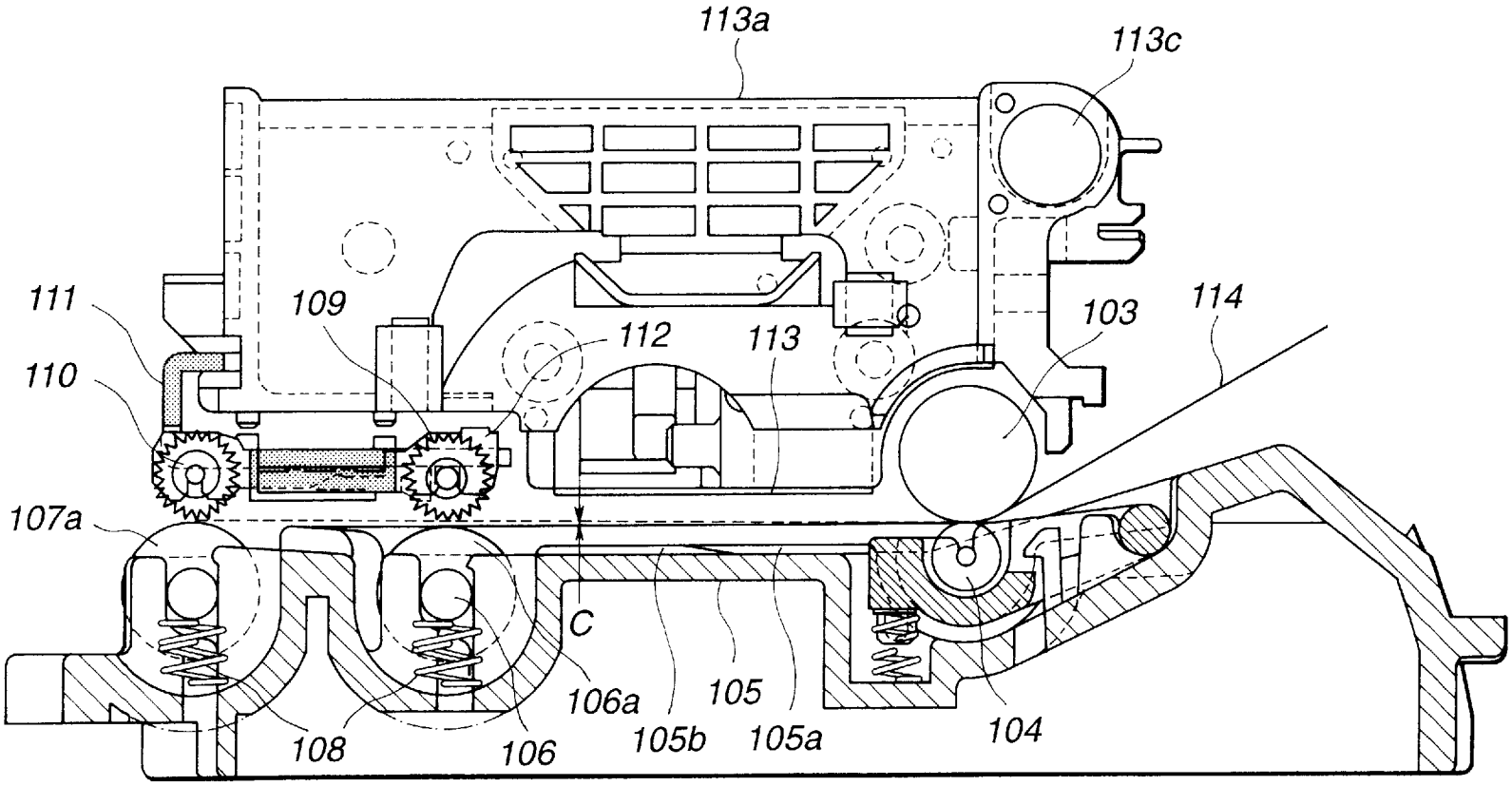
FIG. 9 is a cross-sectional view illustrating the first embodiment when conveying a plastic film.
Figure 10:
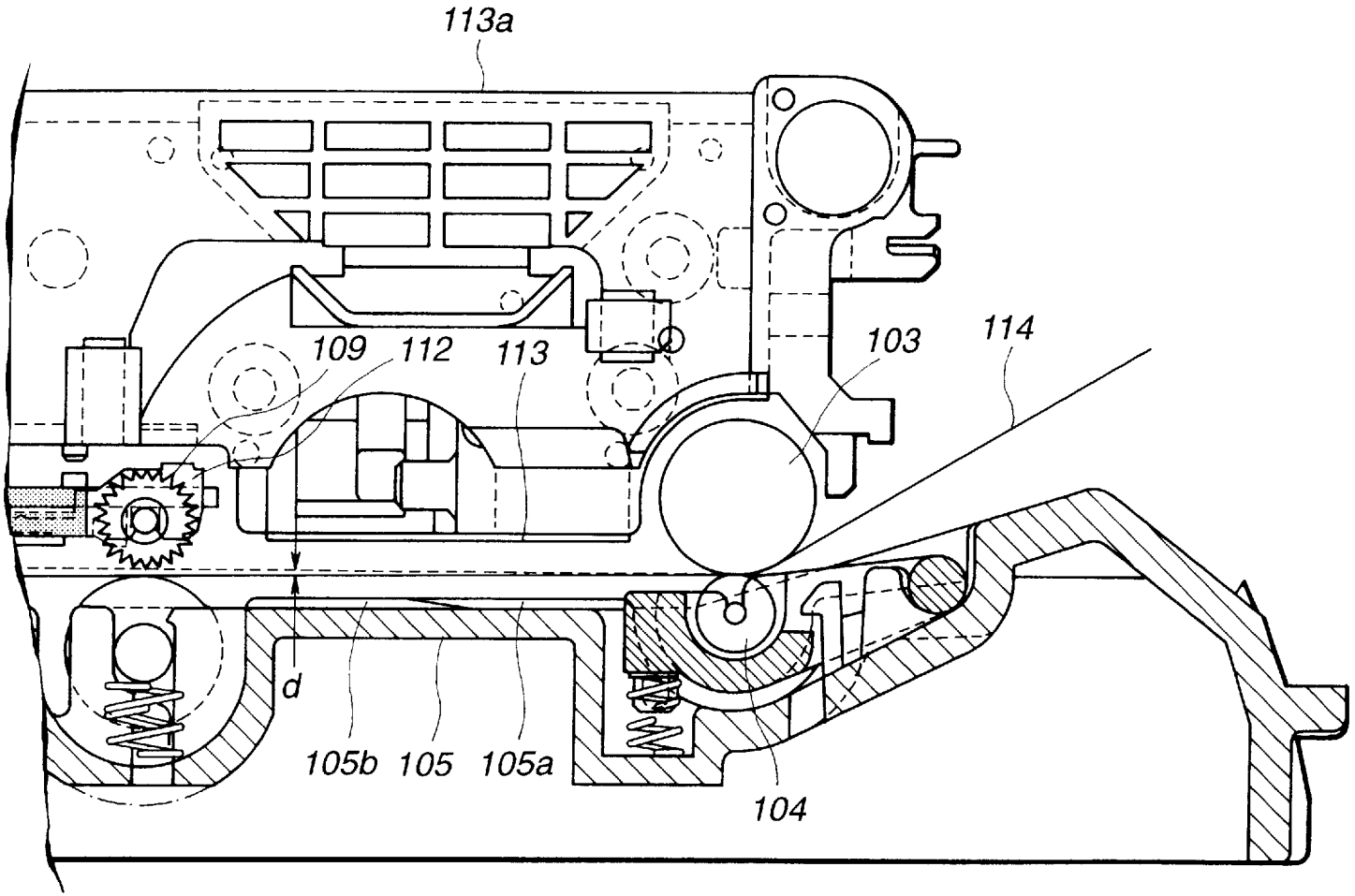
FIG. 10 is a cross-sectional view illustrating a state when ribs are absent when conveying a plastic film.

FIG. 8 illustrates a behavior of the recording sheet 101 based on an experiment when ribs are absent between the discharging rollers 106*a* and 107*b*. The recording sheet 101 contacts the recording head 113 at a portion B. On the other hand, FIG. 7 illustrates a state in which the amount of curl due to the stiffness of the recording sheet 101 is reduced. It has been experimentally confirmed that the recording sheet 101 does not contact the recording head 113 due to the above-described ribs 105*c*. The height of the rib 105*c* is set to be lower than the height of the line obtained by connecting the contact point between the spur 109 and the discharging roller 106*a* to the contact point between the spur 110 and the discharging roller 107*a*. A large value of the height of the rib 105*c* causes a load when conveying an envelope or the like, thereby causing a failure in a discharging operation. FIGS. 9 and 10 illustrate states in which a very stiff sheet, such as a plastic film 114 or the like, is conveyed. In FIG. 9, a solid line on the platen 105 indicates a state of conveyance before the plastic film 114 reaches the discharging rollers 107*a,* and a dotted line indicates a state after the plastic film 114 reaches the dicharging rollers 107*a*.

In FIG. 10, a solid line indicates a state of conveyance of the plastic film 114 when ribs are absent between the discharging rollers 106*a* and 107*a,* and a dotted line indicates a state of conveyance when the plastic film 114 reaches the discharging rollers 107*a*. At that time, the distances c and d between the plastic film 114 and the recording head 113, which determine the recording quality, in the respective cases have the relationship of c<d. The rates of change c' and d' of the distances c and d have also the relationship of c'<d'. That is, the displacement in the distance when ribs are present is smaller than in the other case, and therefore higher-quality recording can be performed even with a stiff sheet. The rib 105*c* is disposed on the production between the discharging rollers 106*a* and 107*a* so as not to contact trough portions of cockling.

Next, a description will be provided of the elastic portions 106*b* and 107*b* provided in the discharging-roller shafts 106 and 107, respectively. The discharging-roller shaft 106 is urged by two compression springs 108 so as to be slidably rotatable, and the discharging-roller shaft 107 is urged by four compression springs 108 having the same spring constant as that of the above-described two compression springs 108. The load of the compression spring 108 is set to a low load value in order to separate the discharging-roller shaft 106 from the recording head 113 due to the stiffness of cockling when the recording sheet 101 has cockling. Furthermore, by forming the elastic portion 106*b,* it is possible to unify the load applied to the discharging-roller shaft 106, to reduce the load applied to the spurs 109, and thereby to remove transfer traces of ink caused by the spurs 109.

The values of pressure applied to the discharging-roller shafts 106 and 107 differ because of the following reasons.

In the region of the discharging rollers 106*a,* the distance between the recording sheet 101 and the recording head 113 is maintained constant, and the discharging-roller shaft 106 is separated from the recording head 113 if large cockling is present when recording image data by reducing the feeding pitch of the recording sheet 101, randomly dividing the image data, and increasing the number of scanning operations of the carriage 113*a,* in order to prevent contact between the recording head 113 and the recording sheet 101.

On the other hand, in the region of the discharging-roller shaft 107, the load of this region is set to a value higher than the value of the load of the region of the discharging-roller shaft 106 in order to prevent rubbing between the recording sheet 101 and the recording head 113 due to a raise of a heavy recording sheet, such as an envelope, a post card or the like, or a recording sheet whose weight has increased after high-duty-ratio recording when it leaves the conveying roller 103 and the pinch rollers 104, bending of the recording sheet 101 during recording, or rubbing between the recording sheet 101 and the recording head 113 due to such bending.

In order to make the distance between the recording sheet 101 and the recording head 113 constant irrespective of the kind of the recording sheet 113 and other conditions outside the apparatus in the conveying path of the recording sheet 101 determined by the discharging rollers 106*a,* the spurs 110, the conveying roller 103 and the pinch roller 104, an appropriate spring load is set. At that time, it has been experimentally confirmed that rub between the recording sheet 101 and the recording head 113 can be reduced irrespective of the kind of the recording sheet 101 and environmental conditions of the use when the spring load $N_6$ applied to the discharging-roller shaft 106 is lower than the spring load $N_7$ applied to the discharging-roller shaft 107 (i.e., $N_7>N_6$). In order to reduce the production cost and remove mistakes in an assembling operation, six compression springs 108 having the same configuration are used. Two compression springs 108 are provided for the discharging-roller shaft 106, and four compression springs 108 are provided for the discharging-roller shaft 107. In order to obtain desired spring loads, the surfaces for mounting the respective compression springs 108 have different heights.

Figure 11:
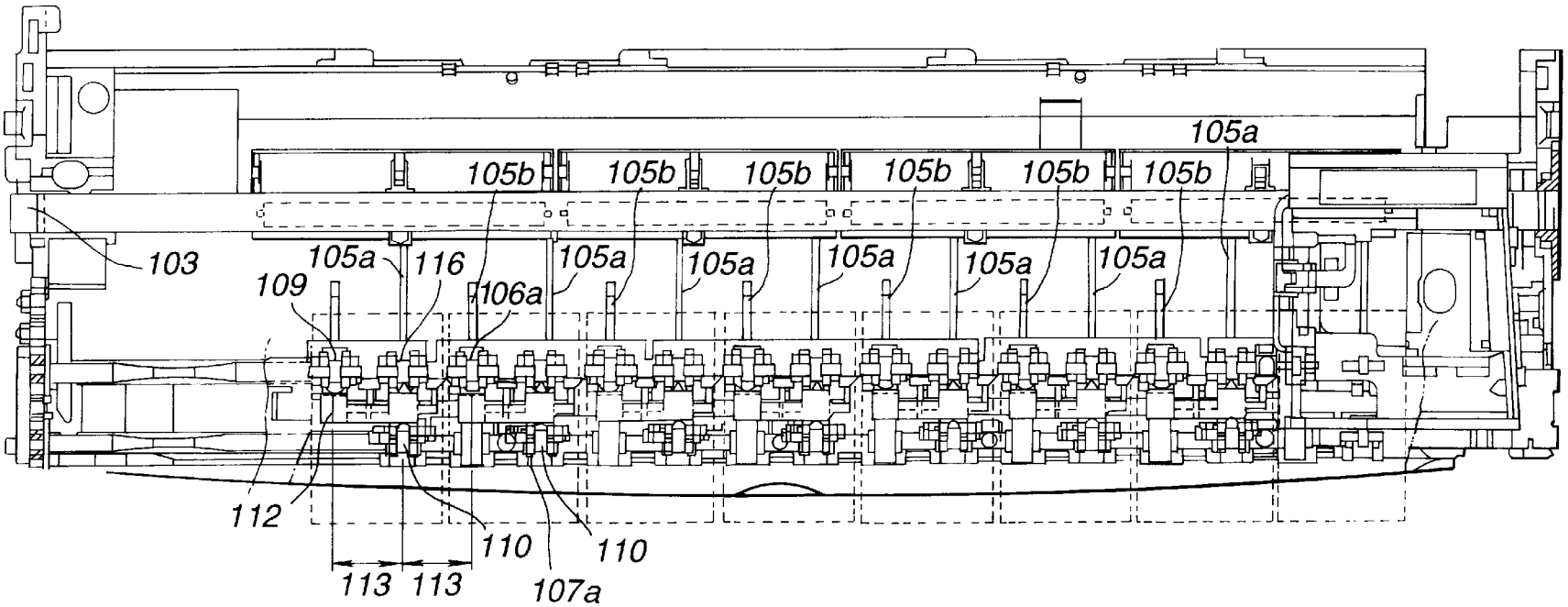
FIG. 11 is a plan view illustrating the arrangement of a spur holder.
Figure 12:
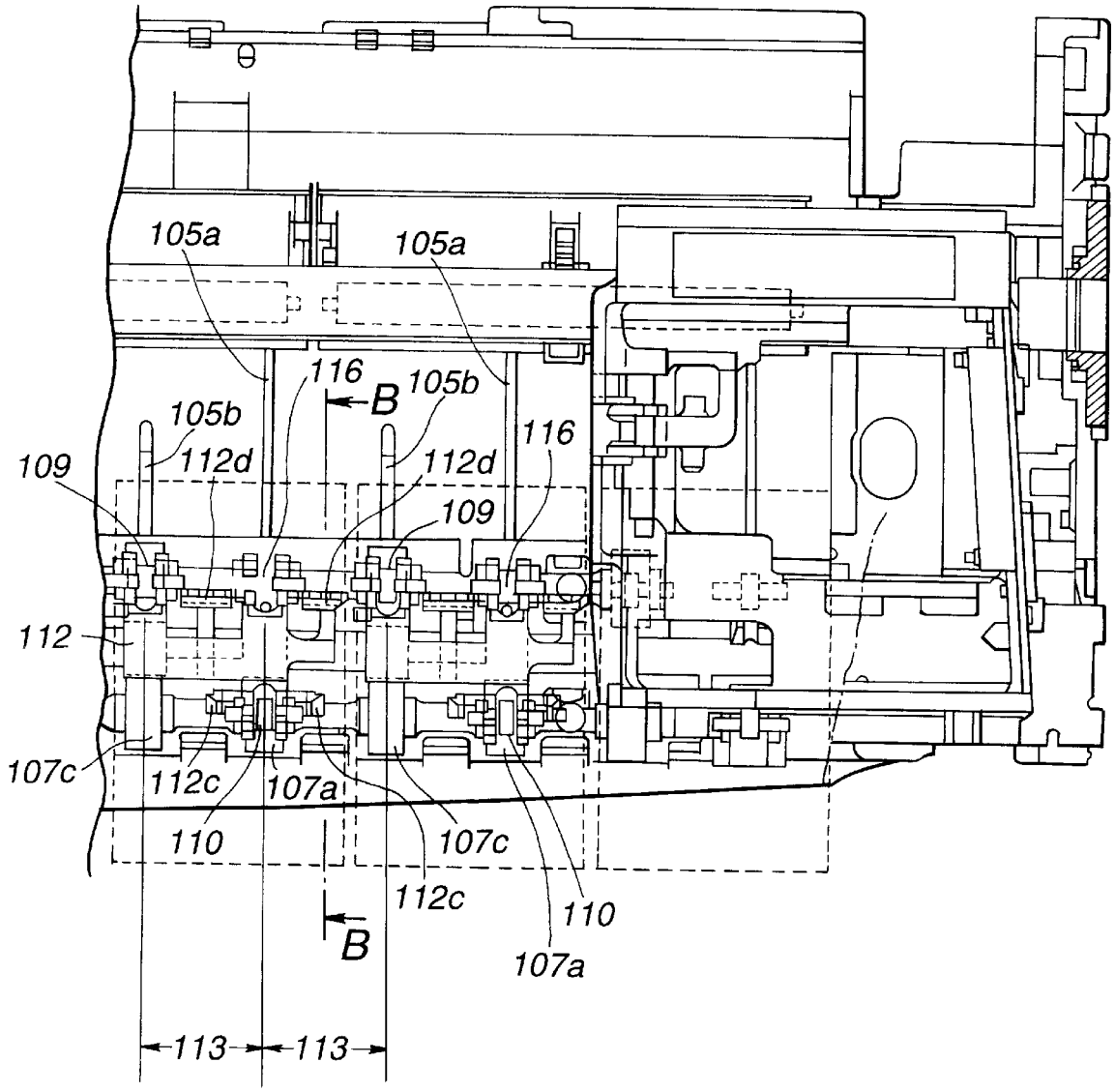
FIG. 12 is a detailed plan view of the spur holder.
Figure 13:
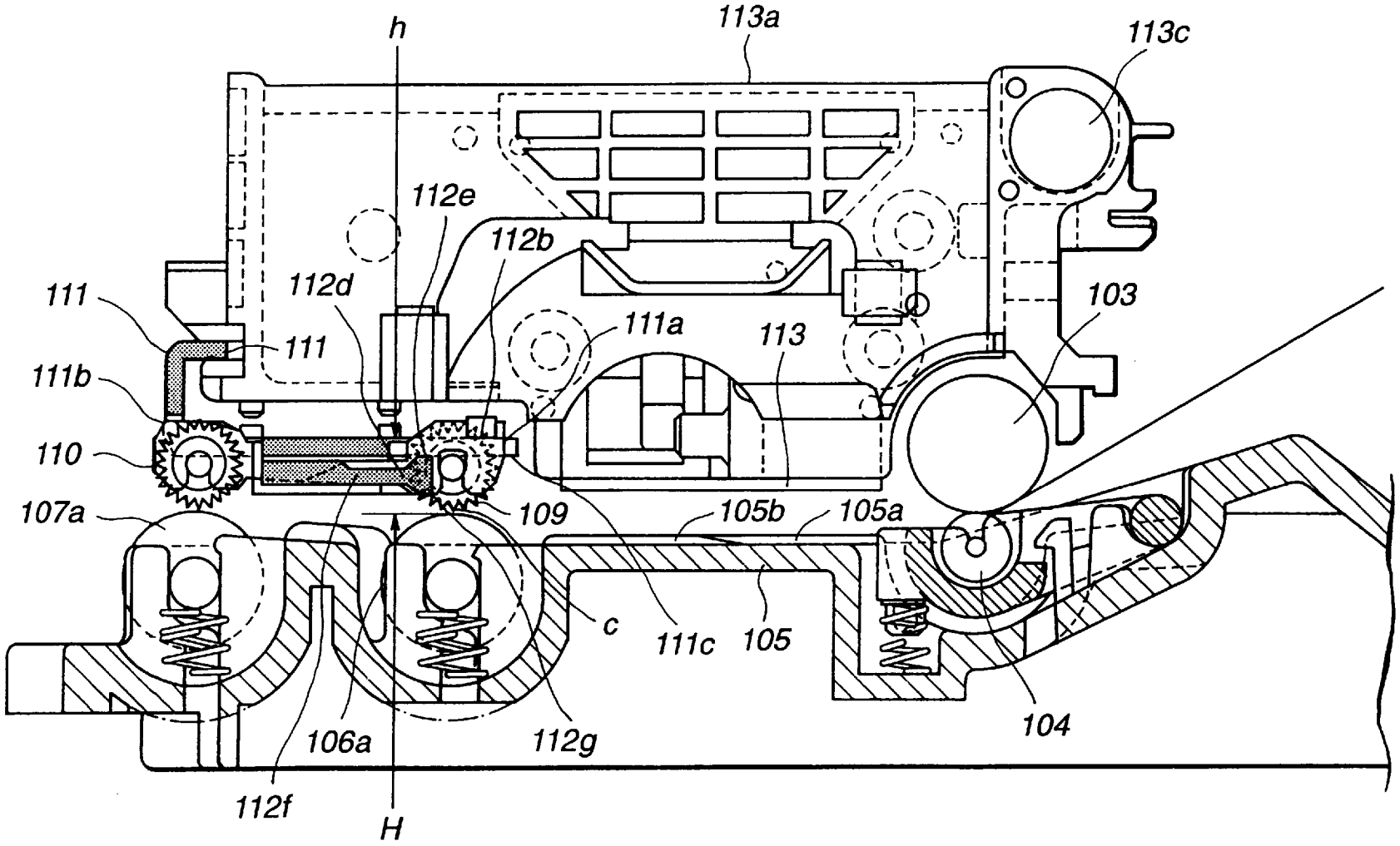
FIG. 13 is a cross-sectional view taken along line B—B shown in FIG. 12.
Figure 14:
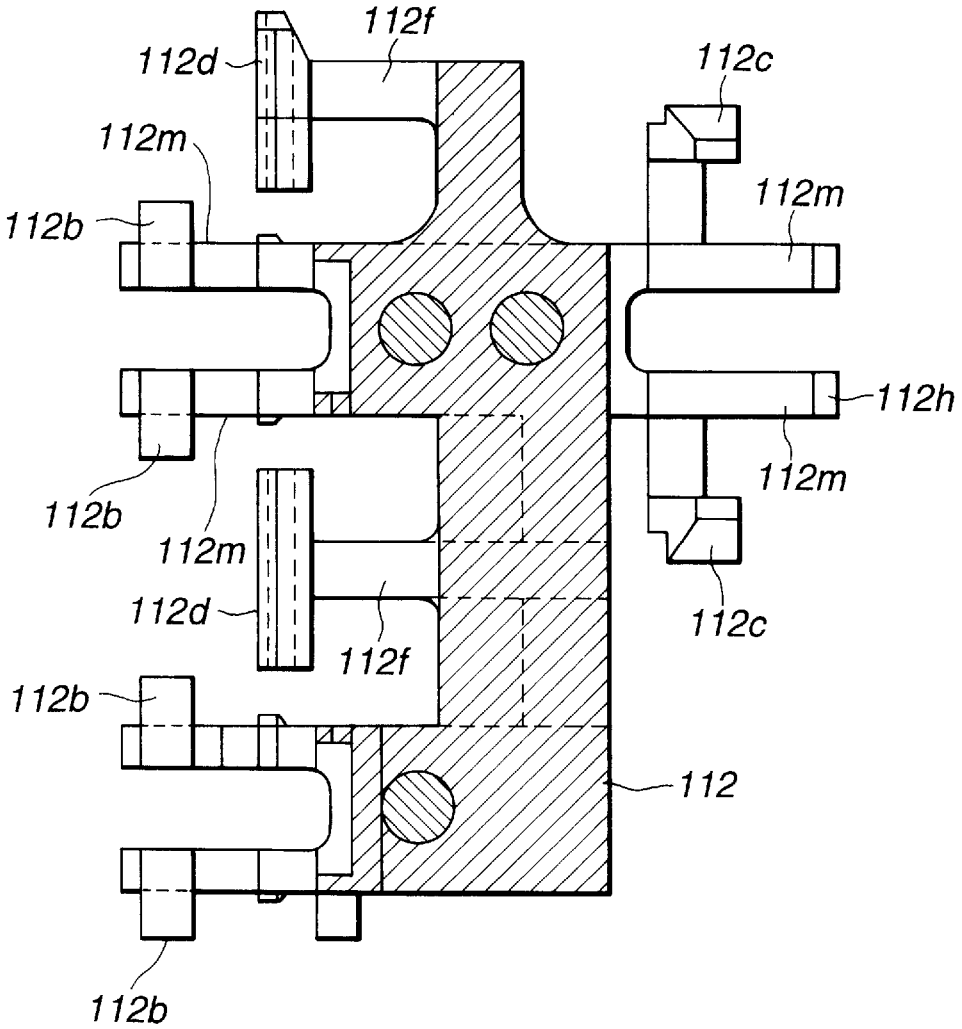
FIG. 14 is a plan view of the spur holder.
Figure 15:
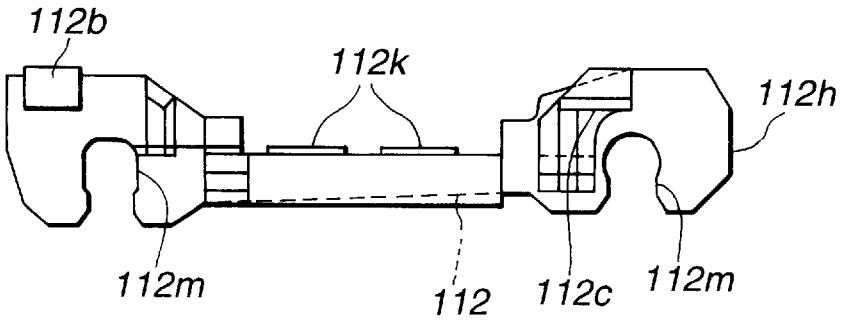
FIG. 15 is a side view of the spur holder.

Next, the spurs 109 and 110, and the spur holder 112 will be described in detail. FIGS. 11 and 12 are schematic diagrams of the ink-jet recording apparatus as seen from above. FIGS. 14 and 15 are a plan view and a side view of the spur holder 112, respectively. In FIGS. 11 and 12, each portion surrounded by dotted lines represents a unit comprising the spur holder 112 and the spurs 109 and 110. This recording apparatus is configured by eight such units. The spurs 109 are disposed at intervals of about less than 13 mm above the discharging-roller shaft 106. FIG. 13 illustrates a cross section taken along line B—B shown in FIG. 12. Bearings 112*m* (see FIG. 14) rotatably support respective shafts 109*a* and 110*a* of the spurs 109 and 110. The spur holder 112 is positioned by contact surfaces 112*b* and a contact surface 111*a* of the guide rail 111, and is anchored and fixed by notches 111*b* of the guide rail 111 and engaging portions 112*c* of the spur holder 112. That is, the lower surface of the guide rail 111 is made in contact with projections 112*k,* and the contact surfaces 112*b* and the engaging portions 112*c* are engaged with the upper surface of the guide rail 111. Contact portions 112*e* of regulating members 112*d* for regulating raise of the recording sheet 101 having cockling contact a contact surface 111*c* of the spur shaft 109*a,* and the height of the regulating member 112*d* is set to h by the contact surface 112*b* and narrow elastic members 112*f* for allowing elastic deformation. The distal end 112*g* of the regulating member has a smooth surface in order to prevent rub of ink at the edge, or the like. According to such a configuration, the distance H between the contact C between the spur 109 and the discharging roller 106*a* and the distal end 112*g* can be accurately set.

Figure 16:
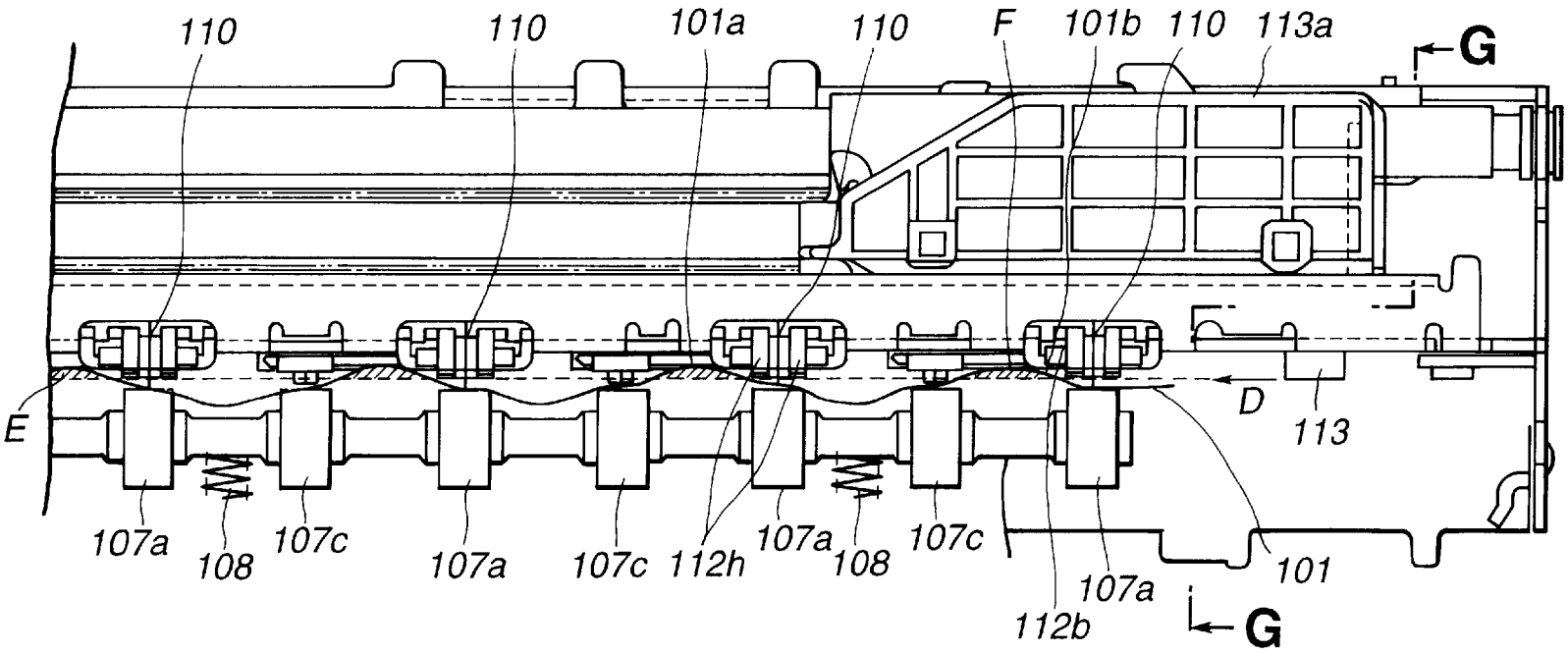
FIG. 16 is a front view illustrating a state of a recording sheet when regulating members are absent.

FIG. 16 is a front view illustrating a state of cockling of the recording sheet 101 when the regulating members 112*d* are absent in the ink-jet recording apparatus of the present embodiment. An arrow D indicates the moving direction of the recording head 113, and a dotted line E present on its production indicates the locus of the recording head 113. Each hatched portion F indicates a region where a crest 101*a* of cockling contacts the recording head 113. In such a state, not only are rub traces produced in the obtained image, but also the recording head 113 is damaged, thereby shortening the life of the recording head 113.

Figure 18:
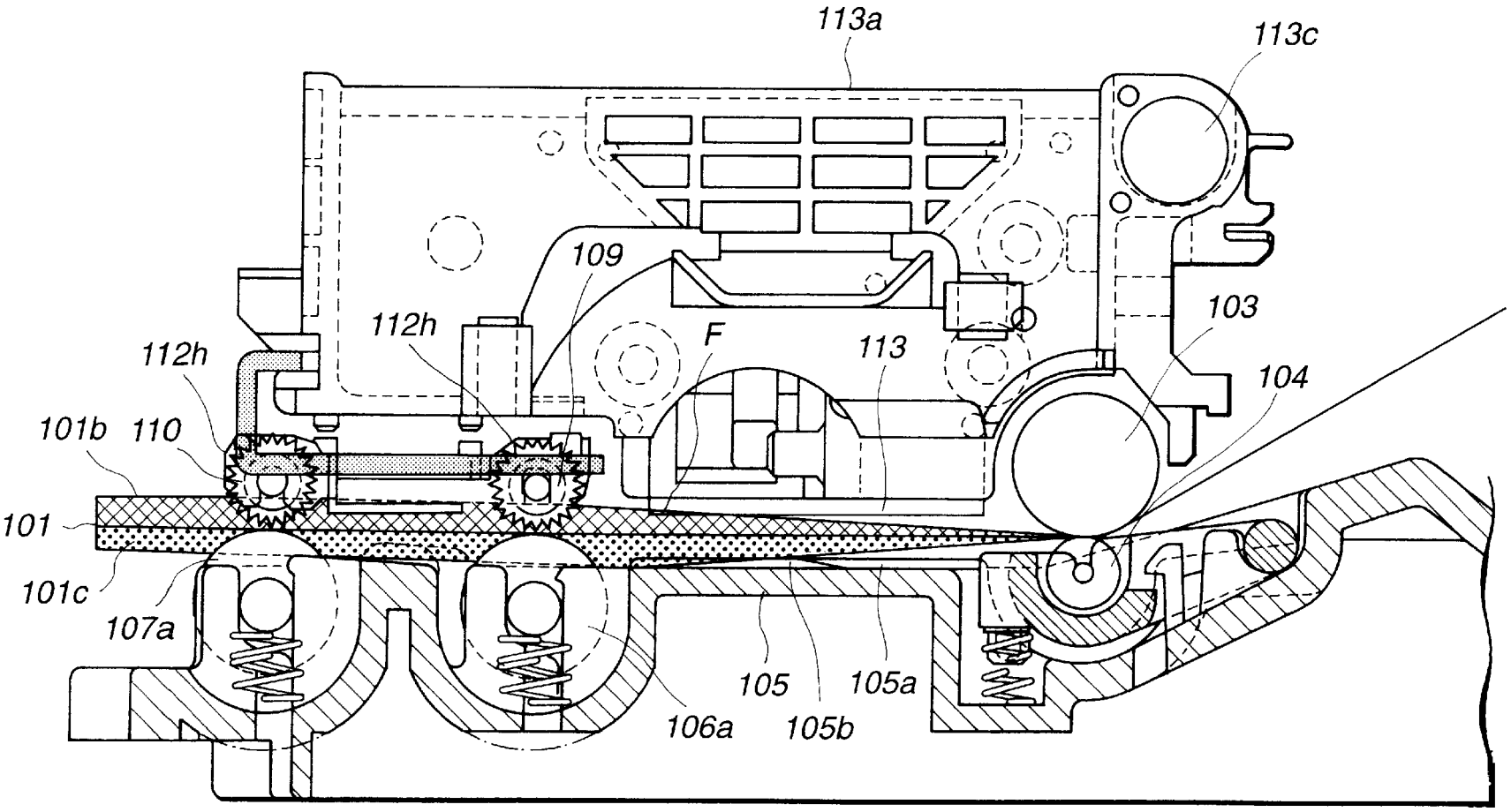
FIG. 18 is a cross-sectional view (taken along line G—G shown in FIG. 16) illustrating a state of the recording sheet when the regulating members are absent.

FIG. 18 is a cross-sectional view taken along line G—G shown in FIG. 16. A surface 101*b* of the recording sheet 101 indicates the slope of the surface, on which recording is performed, of the recording sheet 101 undulated due to cockling. A surface 101*c* of the recording sheet 101 indicates the slope of the surface opposite to the surface 101*b*. The recording sheet 101 contacts the recording head 113 at a portion F.

Figure 17:
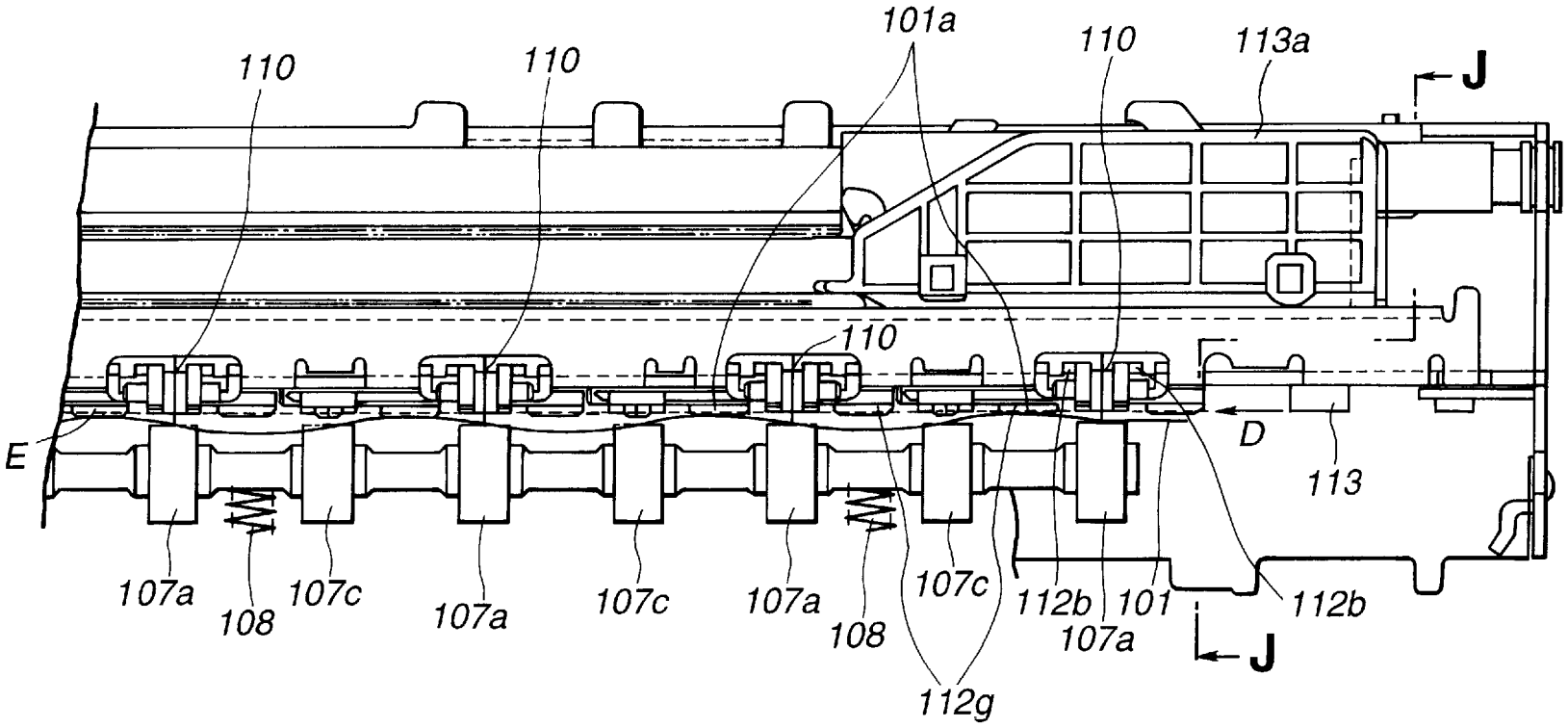
FIG. 17 is a front view illustrating a state of a recording sheet when regulating members are present.
Figure 19:
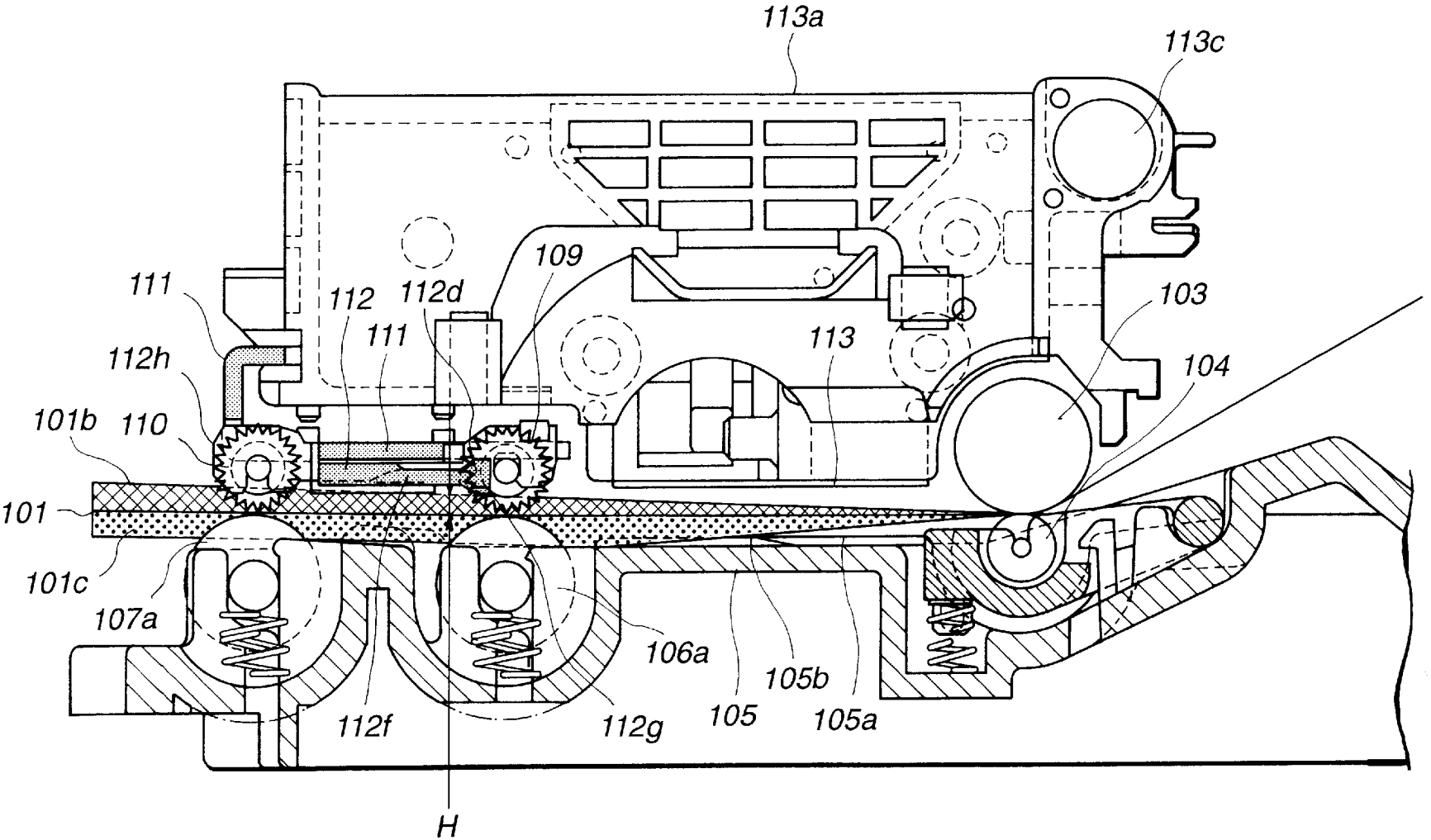
FIG. 19 is a cross-sectional view (taken along line J—J shown in FIG. 17) illustrating a state of the recording sheet when the regulating members are present.

FIG. 19 is a cross-sectional view taken along line J—J shown in FIG. 17. Since the distance between the crest 101*a* of the recording sheet 101 due to cockling and the recording head 113 is limited by the distal end 112*g* at the spur holder 112, rub between the recording sheet 101 and the recording head 113 does not occur.

If the distance H is too large, the recording head 113 rubs the recording sheet 101 before ink dries, thereby disturbing the obtained image. If the distance H is too small, the size of cockling cannot be regulated, and therefore the recording sheet 101 rubs the recording head 113. In the present embodiment, the regulating member 112*d* is disposed in the vicinity of the spur 109, and the distance H is set to about 1 mm which value has provided excellent results in experiments.

Walls 112*h* having a size greater than the outer diameter of the spurs 109 and 110 are formed in the spur holder 112 so that, for example, the distal ends of the spurs 109 and 110 are not bent due to disturbance, and the distal ends of the teeth of the spurs 109 and 110 are not damaged.

Although in this embodiment, two spurs and a spur shaft are provided as a unit in order to reduce the number of components and the number of assembling processes, and thereby reduce the production cost, the number of components can be arbitrary selected depending on their arrangement. The regulating members may be separated from the spur holder. If the regulating member is made of water-repellent fluororesin, since rub traces are produced less frequently, the distance H can be reduced, and therefore the probability of occurrence of cockling can be reduced. The discharging rollers 106*a* and 107*a* are made of plastic resin. The discharging-roller shafts 106 and 107 comprise two-color moldings.

A description will now be provided of the numbers of the discharging rollers 106*a* and 107*a* fixed to the discharging-roller shafts 106 and 107, respectively, and the spurs 109 with reference to FIGS. 4 and 6.

As described above, the discharging-roller shaft 106, the discharging rollers 106*a* and the spurs 109 have the function of maintaining the distance between the recording sheet 101 and the recording head, and separating warp of the recording sheet due to cockling from the recording head. As described above, the interval between adjacent spurs 109 is set to about less than 13 mm, and 16 spurs 109 are provided in total. The interval between adjacent discharging rollers 106*a* is set to about 26 mm, and 8 discharging rollers 106*a* are provided in total. Accordingly, a spur 109 which is not urged by a discharging roller is disposed between two discharging rollers 106*a*. As the above-described limitation in the height of the ribs 105*a* and 105*b,* if the interval between adjacent discharging rollers 106*a* is set to about 13 mm, a trough of the recording sheet 101 having a strong stiffness due to cockling cannot escape, and the recording sheet 101 is raised toward the recording head 113, thereby causing rub with the recording head 113. In order to release the trough of the recording sheet 101, the discharging roller 106*a* having a large diameter is not provided below the spur 116.

As described above, the discharging-roller shaft 107, the discharging rollers 107*a* having a large diameter, and the spurs 110 have the function of guiding the recording sheet 101, such as thick paper or the like, maintaining the distance between the recording sheet 101 and the recording head 113 against disturbance while the recording sheet 101 is discharged, and minimizing undulation of cockling. In order to satisfy the above-described function, eight spurs 110 and sixteen discharging rollers 107*a* and 107*c* are provided in total, and the spurs 110 are urged with low load. Accordingly, the interval between adjacent spurs 110 is set to about 26 mm, and the interval between the center axes of the discharging rollers 107*a* and 107*c* is set to about 13 mm. In the scanning direction of the recording head 113, the discharging roller 107*c* not facing the spur 110 is disposed on the production obtained by connecting the discharging roller 10*a* and the urging member of the spur 110, and the discharging roller 107*a* and the urging member of the spur 110 are disposed on the production from the spur 116, which is not urged, in the direction of the recording-sheet conveying direction. A projection of cockling in the recording sheet 101 is downwardly regulated by the spur 109, and the recording sheet 101 curls toward its back at the region of the discharging roller 107*c* situated in the discharging direction. At that time, if the discharging roller 107*a* is absent, the recording sheet 101 falls in this region. As a result, local deflection of the recording sheet 101 is produced in the vicinity of the recording head 113 and contacts the recording head 113. If the load applied to the discharging roller 107*a* is too small, since the discharging-roller shaft 107 cannot resist the weight of the recording sheet 101 and therefore cannot support the recording sheet 101, deflection of the recording sheet 101 is produced, and the recording sheet 101 contacts the recording head 113. Accordingly, the discharging roller 107*c* prevents such deflection of the recording sheet 101. Furthermore, since the number of discharging rollers is large, a discharging force caused by their weight increases, and the recording sheet 101 can be assuredly discharged with a small discharging force.

In the present embodiment, by using two discharging-roller shafts, the sheet 101 can be discharged with a discharging force lower than when a single discharging roller is used.

Although the discharging roller 107*c* is made of plastic resin using two-color molding, it may be made of rubber. Furthermore, although in order to increase the discharging property a member having a high coefficient of friction is used, the same material as for the shaft member may be used in order to prevent deflection of the recording sheet 101.

Second Embodiment

Figure 20:
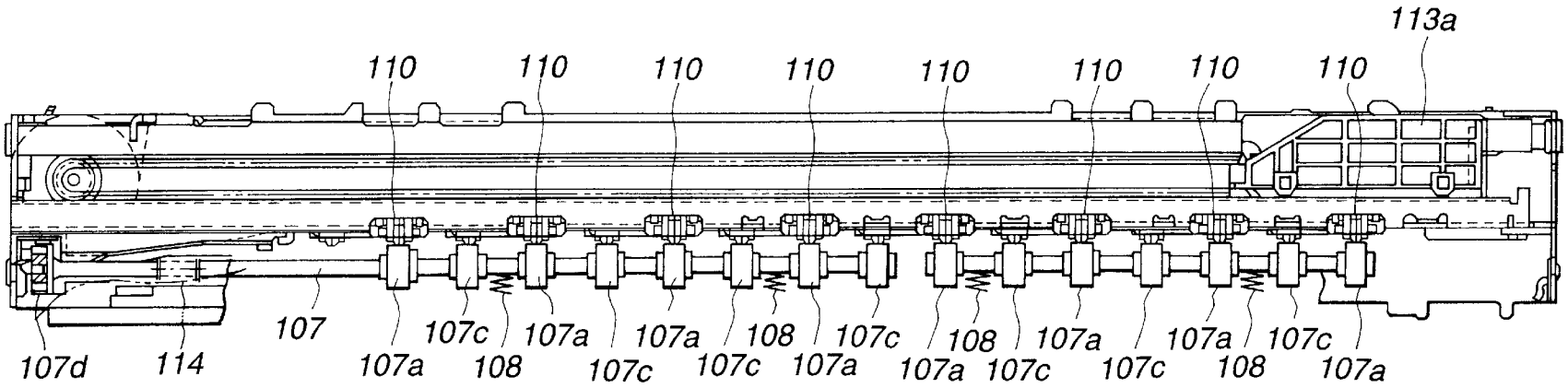
FIG. 20 is a plan view illustrating a second embodiment of the present invention.

FIG. 20 is a front view illustrating an ink-jet recording apparatus according to a second embodiment of the present invention. Although a method of engagement is not shown, a transmission gear unit 107*d* is fixed to a discharging-roller shaft 107 via a compression spring 114. By thus forming an elastic portion, it is possible to unify the discharging pressure, to provide a more stable period in cockling, and to obtain a high-quality image.

Third Embodiment

Figure 21:
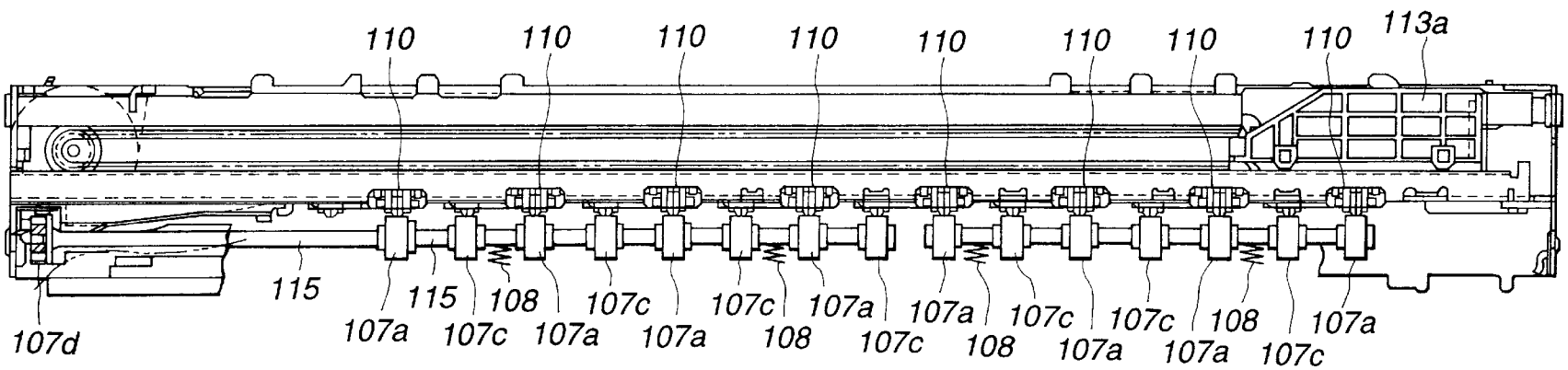
FIG. 21 is a plan view illustrating a third embodiment of the present invention.

FIG. 21 is a front view of an ink-jet recording apparatus according to a third embodiment of the present invention. The outer diameter of a discharging-roller shaft 115 is smaller than the outer diameter of the discharging-roller shaft 107 uniformly over the entire span. According to such a configuration, it is possible to unify the discharging pressure, and to reduce the sliding load at the regions of springs 108.

Fourth Embodiment

Figure 22:
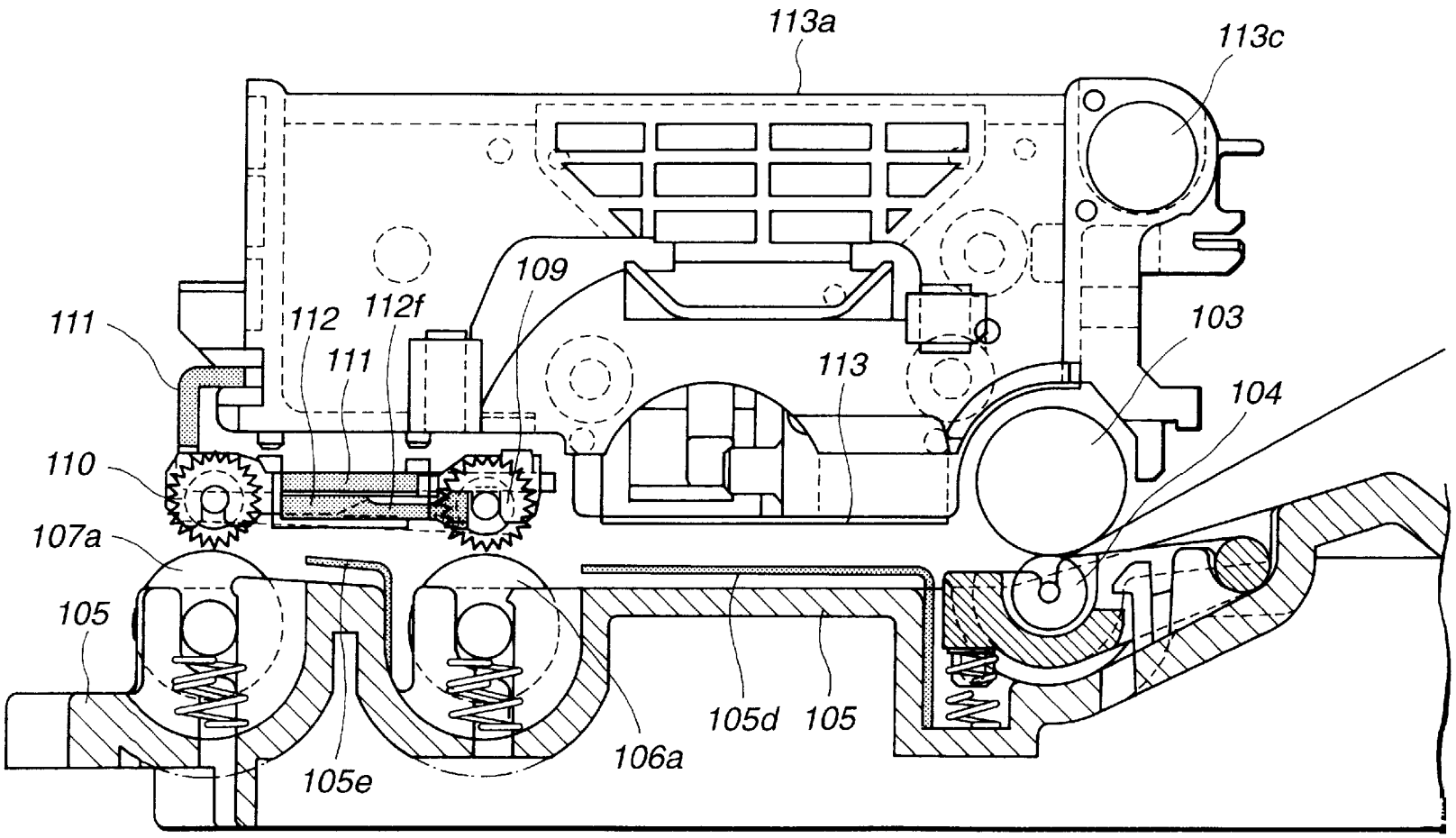
FIG. 22 is a plan view illustrating a fourth embodiment of the present invention.

FIG. 22 is a cross-sectional view illustrating an inkjet recording apparatus according to a fourth embodiment of the present invention. A rib 105*d* disposed above a platen 105 comprises, for example, a spring member made of a thin plate, and forms an elastic member. According to such a configuration, the load torque applied to the motor described in the first embodiment can be reduced. Furthermore, by providing a movable rib 105*e,* the load torque applied to the discharging-roller shaft due to the thickness of the recording sheet 101 can be further reduced. Particularly, accuracy in recording after the recording sheet 101 has passed through a pinch roller 104 can be improved.

As described above, even when the recording sheet 8 undulates (cockling) after recording, the urging force of the discharging-roller spring 62 is determined so that it vertically moves in accordance with the behavior of the recording sheet 8. Accordingly, the pinch roller 57 and the discharging roller 60 is urged by the pinch-roller spring 59 and the discharging-roller spring 62 toward the conveying roller 52 and the spur 61 fixed to the chassis 50, respectively, and the pinch roller 57 and the discharging roller 60 vertically move in accordance with the thickness and the behavior of the recording sheet 8. Hence, the distance between the recording head 1 and the recording sheet 8 is constant, and therefore an adjusting lever for adjusting the distance between the recording head 1 and the recording sheet 8 or the like, which has been necessary in the conventional apparatus, becomes unnecessary.

The spurs 61 are rotated by being driven by the discharging rollers 60, and can discharge the recording sheet 8. Two discharging rollers 60 are provided in order to prevent rub between the recording sheet 8 and the recording head 1 when conveying and discharging a stiff recording sheet, such as a post card, an envelope or the like, or a curled recording sheet.

Figure 3:
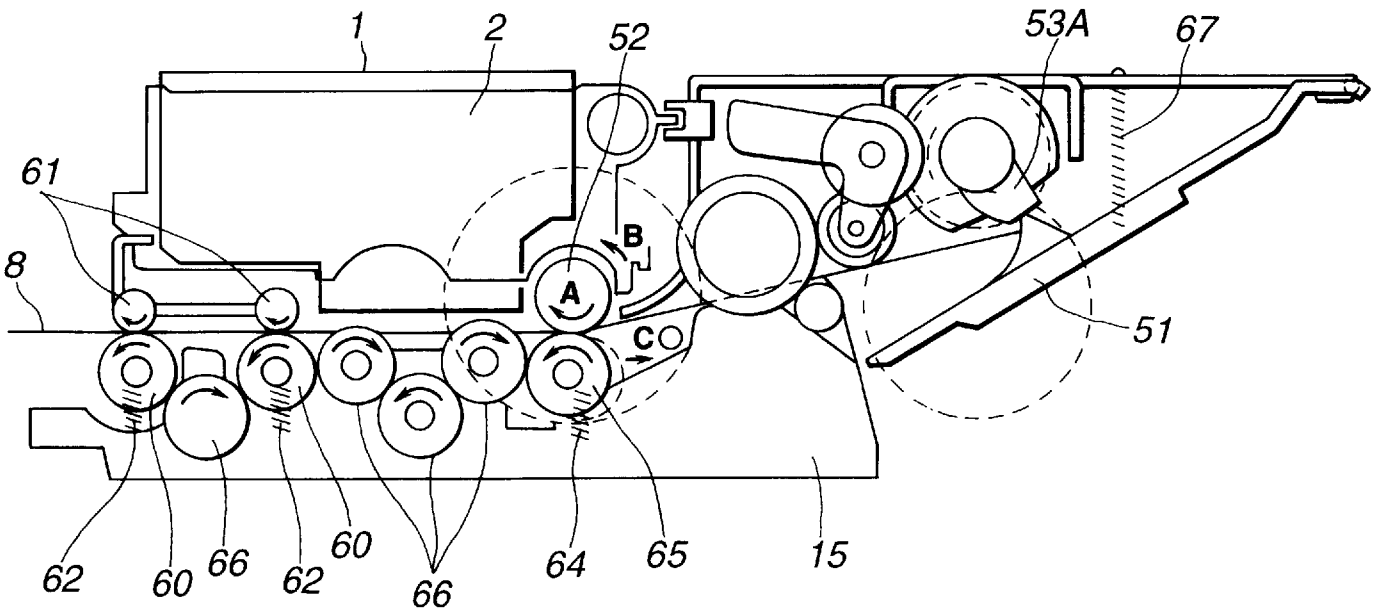

Next, a description will be provided of the transmission of the drive of the discharging rollers 60 with reference to FIGS. 1 through 3. The drive transmission unit for the discharging rollers 60 is held at a left-end portion out of the recording-sheet conveying path on the base 15. As shown in FIGS. 1 and 3, the drive is transmitted from a discharging idle roller 65, which is in pressure contact with the conveying roller 52 by an idle-roller spring 64, to the discharging rollers 62 via an idle gear train 66. When the conveying roller 52 rotates in the feeding direction (the direction of the arrow A), the drive is transmitted to the idle gear train 66 via the discharging idle roller 65, i.e., the discharging rollers 60 rotate. When the conveying roller 52 rotates in the reverse direction (the direction of an arrow B), the discharging idle roller 65 moves in a direction of separating from the idle gear train 66 (the direction of an arrow C), and drive transmission to the idle gear train 66 is not performed.

As described above, the discharging rollers 60 and their drive transmission unit are also held on the base 15.

Figure 23:
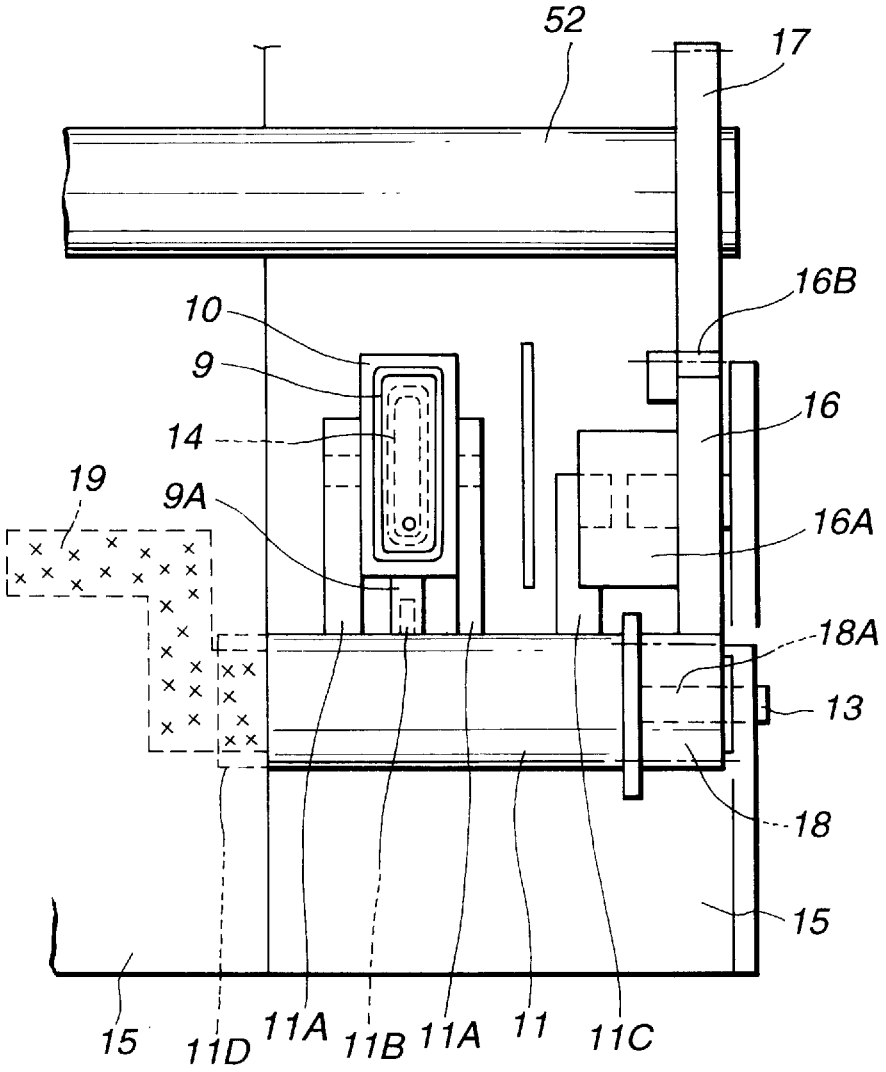
FIGS. 23 and 24(*a*) and 24(*b*) are diagrams illustrating a pumping mechanism of the recording apparatus shown in FIG. 1.
Figure 24A:
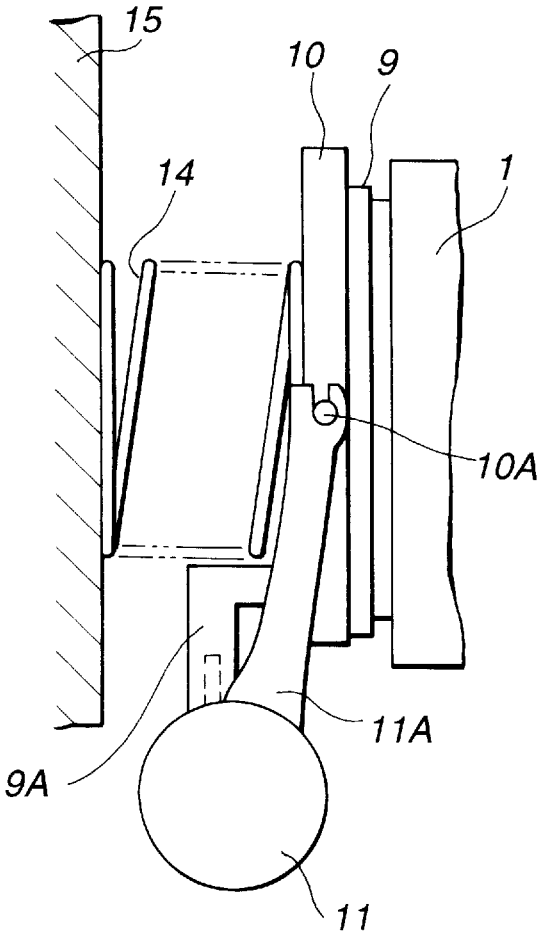
Figure 24B:
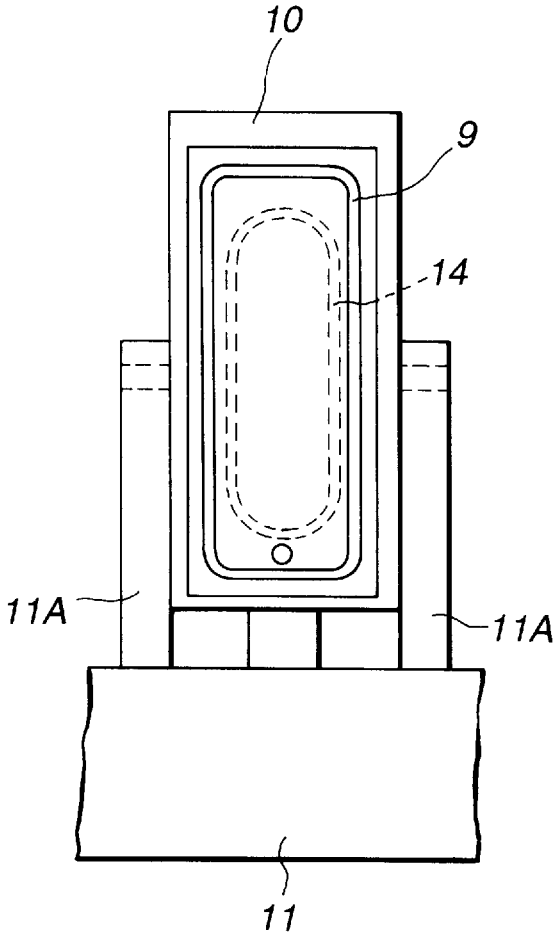

Next, a description will be provided of a pumping mechanism. In FIGS. 1, 23 and 24, a cap member 9, made of an elastic material and capable of encapsulating the recording head 1, is made of an appropriate material, such as chlorinated butyl rubber or the like. The cap member 9 is integrally held on a cap holder 10. The cap holder 10 is rotatably held by an arm unit 11A integrally extending from a cylinder 11. The cylinder 11 incorporates a piston (not shown), and a negative pressure can be produced within the cylinder 11 by driving a piston shaft 13.

The cap 9 includes a flexible joint portion 9A integrally formed therewith. By pushing the joint portion 9A into a joint portion 11B provided on the cylinder 11 with having an interference, the cylinder 11 and the cap 9 are connected together in a sealed state.

Next, a description will be provided of a method of performing pressure connection of the cap 9 relative to the recording head 1 and removing the cap 9 from the recording head 1. As described above, the cap 9 integrally held by the cap holder 10 is hermetically connected to the cylinder 11, and the cap holder 10 is rotatably held by the arm unit 11A relative to the cylinder 11.

As shown in the side view of FIG. 24(*a*) and in the front view of FIG. 24(*b*), a cap spring 14 is provided between the base 15 and the cap holder 10 so as to always urge the cap holder 10 toward the recording head 1. The cylinder 11 is supported by the base 15 so as to rotatable around a cylinder shaft.

Accordingly, a rotating force around the cylinder shaft is provided for the cylinder 11 and the cap 9 by the cap spring 14. As shown in FIGS. 1 and 23, a cylinder control unit 11C is integrally formed on the cylinder 11, and the distal end of the cylinder control unit 11C contacts a cam portion 16A of a pump cam gear 16 rotatably held on the base 15.

Accordingly, the rotation of the cylinder 11 is controlled by the cam portion 16A of the pump cam gear 16 via the cylinder control unit 11C. That is, by vertical movement of the cylinder control unit 11C along the cam portion 16A of the pump cam gear 16, the cap 9 can be capped on or removed from the recording head 1.

The pump cam gear 16 and the driving transmission unit held by the base 15 are provided at right-end portions separated from the recording-sheet conveying path on the base 15. The pump cam gear 16 can be selectably connected to an LF gear 17 press fitted on the conveying roller 52. By transmitting the drive of a sheet-feeding motor (not shown) to the LF gear 17 via a gear train (not shown), and performing a clutch operation (not shown) by the movement of the carriage 2, the drive of the sheet-feeding motor can be transmitted to the pump cam gear 16.

The pump cam gear 16 is connected to a cylinder cap gear 18. By fitting a boss 18A provided in the inner wall of the cylinder cap gear 18 in a lead groove (not shown) provided in the piston shaft 13, the rotating movement of the pump cam gear 16 is converted into the linear movement of the piston shaft 13.

When the carriage 2 does not perform a clutch operation, since a partly untoothed portion 16B is provided on the pump cam gear 16, the transmission of the LF gear 17 is disconnected, and therefore the drive is not transmitted to the pump cam gear 16.

As described above, in the pumping mechanism, the cap 9 can be connected to the recording head 1 by pressure by providing the cap spring 14 between the base 15 and the cap holder 10. Accordingly, the recording head 1 is capped when recording is not performed, thereby preventing the nozzle from drying. In addition, by operating the pump unit during a capping operation when a failure in a discharging operation occurs due to a bubble generated in the nozzle or dust adhering to the nozzle unit to suction ink from the nozzle unit of the recording head 1, the discharging operation can be returned to a normal state.

Next, a description will be provided of a waste-ink absorbing member with reference to FIGS. 2 and 23. Waste ink absorbed from the recording head 1 via the cap 9 by the above-described pumping mechanism enters the cylinder 11, and is discharged from a cylinder end 11D by the movement of a piston (not shown). The cylinder end 11D is inserted in the base 15, and is rotably held by the base 15.

Since another end of the cylinder 11 is rotatably held by the base 15 via the cylinder cap gear 18, the entire pumping mechanism is rotatably supported by the base 15.

A cylinder absorbing member 19 is inserted in the cylinder end 11D from which waste ink is discharged. Since the cylinder absorbing member 19 must have a property of efficiently discharging waste ink present within the cylinder 11 to the outside, a material having an excellent ink-transfer property, such as a foam sponge, is selected. As shown in FIGS. 2 and 23, the cylinder absorbing member 19 is surrounded by, i.e., in pressure contact with, waste-ink absorbing members 20, 21 and 22 within the base 15.

Accordingly, waste ink within the cylinder 11 is transferred from the cylinder absorbing member 19 to the waste-ink absorbing members 21, 22 and 23.

A material having a high ink-holding property, such as a laminated sheet of paper or a high-molecular material, is selected for the waste-ink absorbing members 20, 21, 22 and 23. As shown in FIG. 2, the waste-ink absorbing members 20, 21, 22 and 23 are held within the base 15. Since the base 15 includes the pinch-roller unit and the discharging-roller unit, it does not have a uniform cross section.

A pulp material is mostly used for the waste-ink absorbing member from the viewpoint of the cost and the absorption property, and is formed using cutting dies. Accordingly, a plurality of waste-ink absorbing members are accommodated within the base 15 in order to efficiently dispose the members within the base 15 and to secure a large capacity for waste ink.

In the present embodiment, four pieces of waste-ink absorbing members 20, 21, 22 and 23 are used, and the cylinder absorbing member 19 is disposed in pressure contact with the waste-ink absorbing members 20, 21 and 22. According to such arrangement, the cylinder absorbing member 19 is fixed by being surrounded by the members 20, 21 and 22. Hence, the cylinder absorbing member 19 is prevented from leaving the cylinder 11, and therefore ink does not leak.

By surrounding the cylinder absorbing member 19 with the waste-ink absorbing members 20, 21 and 22, a large contact area can be obtained, and therefore an excellent waste-ink transfer property can be obtained.

Figure 25:
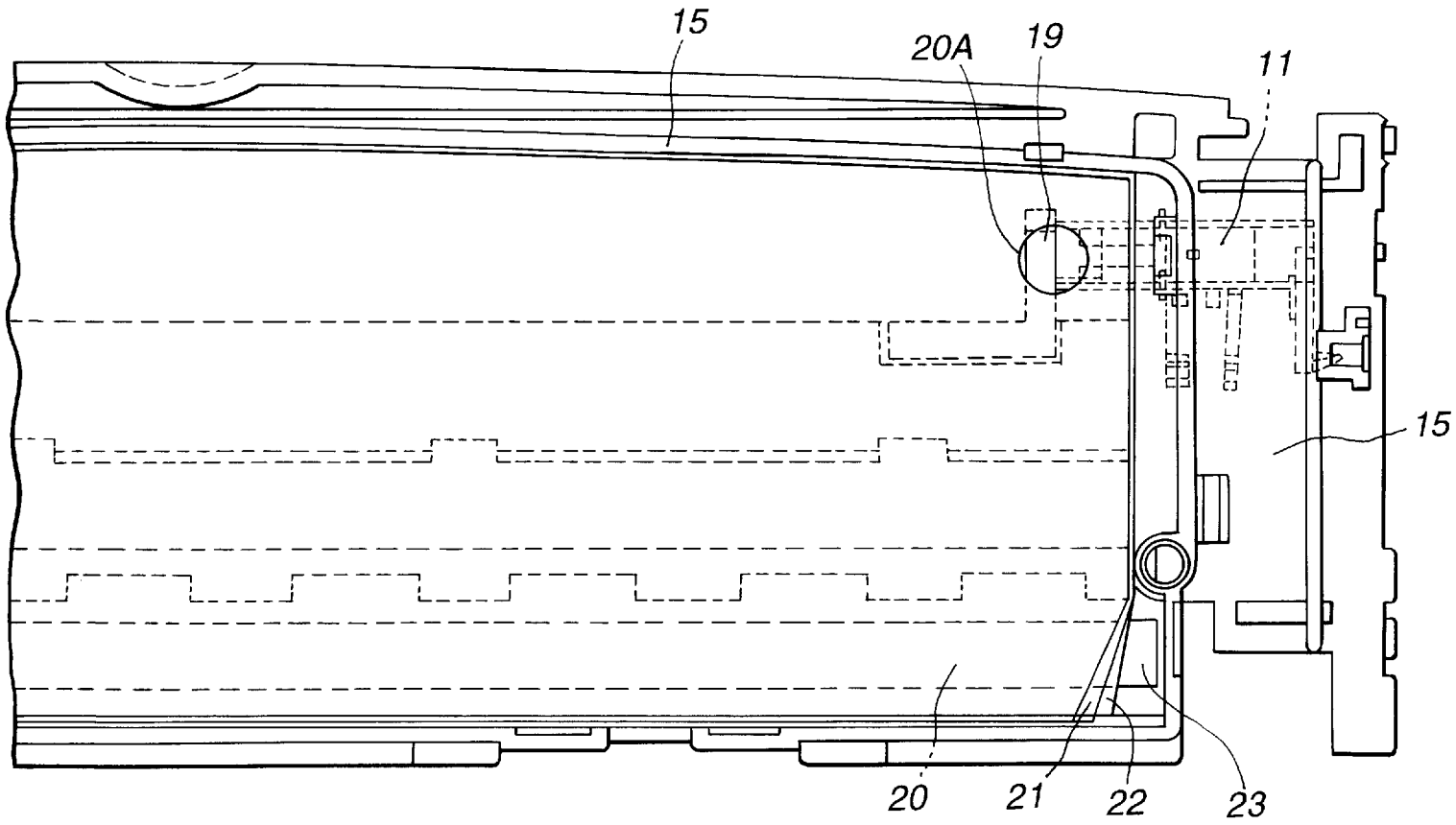
FIG. 25 is a schematic rear view of the recording apparatus shown in FIG. 1.

Next, a description will be provided of a method of holding the waste-ink absorbing members with reference to FIGS. 2 and 25. As described above, four waste-ink absorbing members are used and accomodated within the base 15. However, if these members are used as a base unit, they tend to leave the base 15. Accordingly, as shown in FIG. 2, after accommodating the waste-ink absorbing members within the base 15, a waste-ink seal 24 covers these members as a cap. The waste-ink seal 24 comprises a transparent polyethylene sheet, so that the waste-ink absorbing members accommodated within the base 15 can be seen from the back of the base 15.

Furthermore, as shown in FIG. 25, by changing the lengths of the ends of the waste-ink absorbing members step-wise, the waste-ink absorbing members 20, 21, 22 and 23, and the cylinder absorbing member 19 can be visually checked from the side of the waste-ink seal 24. A hole 20A is provided in the absorbing member 20, so that the cylinder absorbing member 19 present within the case 15 can be visually confirmed. Thus, all of the absorbing members can be seen from the outside in the state of units by providing the transparent waste-ink seal 24. Hence, it is possible to confirm if the absorbing members are accommodated in a normal state, or if any of the absorbing members lacks.

Figure 26:
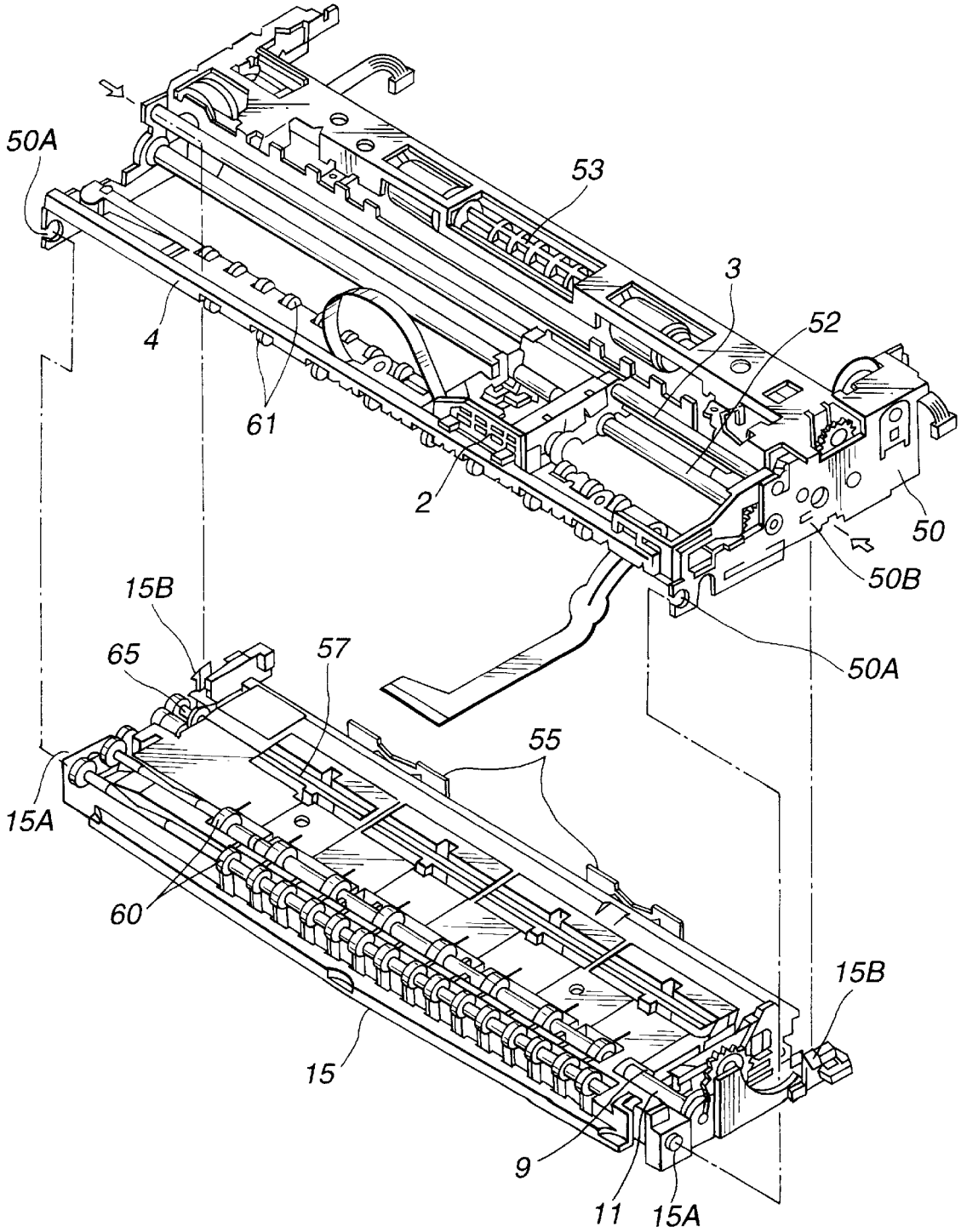
FIG. 26 is a diagram illustrating units of the apparatus shown in FIG. 1.
Figure 27:
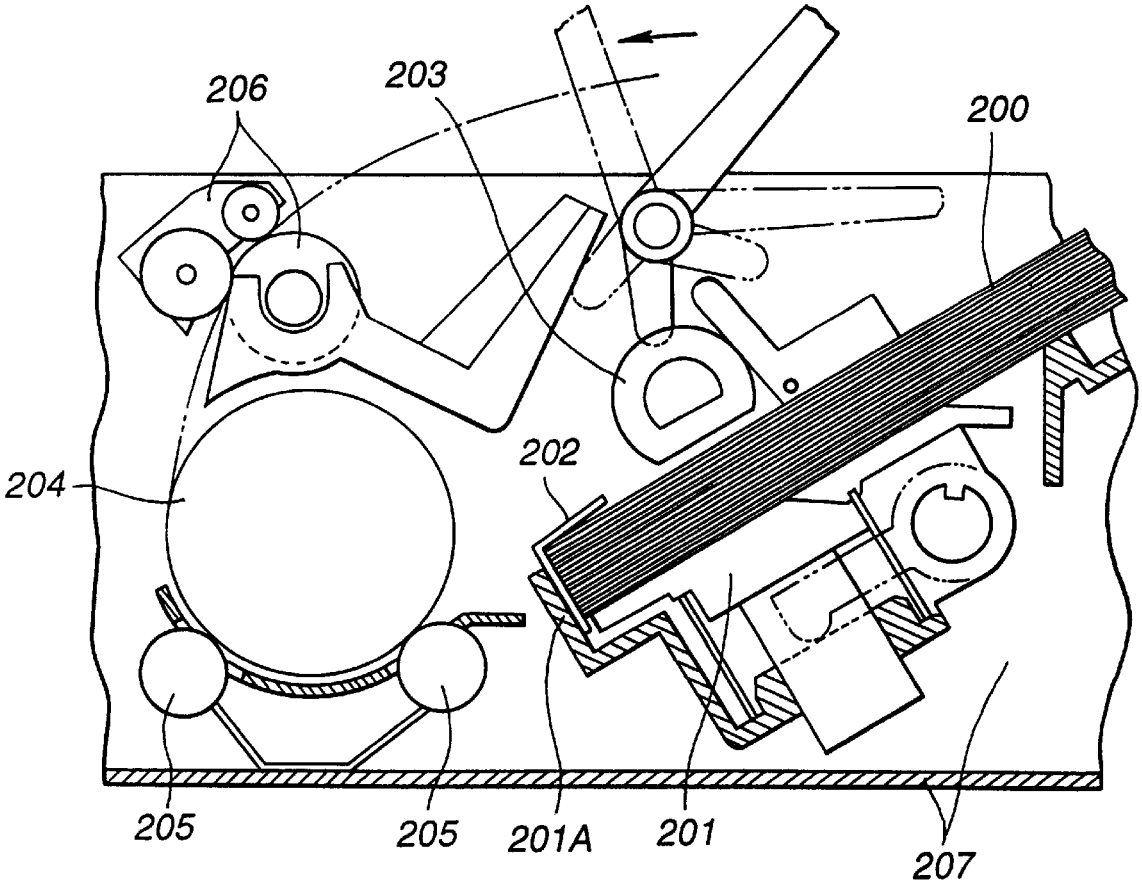
FIG.27 PRIOR ART
FIG. 27 is a schematic cross-sectional view illustrating a conventional recording apparatus.

Next, a description will be provided of the configuration of a printer unit with reference to FIG. 26. As described above, the base 15 holds the pumping mechanism, the pinch-roller unit, the sheet-discharging unit and the waste-ink absorbing members, as well as the sheet-feeding stack unit, the separation means and the drive transmission unit. These components constitute a base unit.

The chassis unit comprises the conveying roller 52, the carriage guide shaft 3 and the feeding-roller shaft 53 fixed to the chassis 50, the guide rail 4 holding the carriage 2 and the spurs 61, and the like.

The printer unit is configured by assembling the base unit shown in the upper portion of FIG. 26, and the chassis unit shown in the lower portion of the FIG. 26. The base unit and the chassis unit are combined together by fitting a boss 15A provided on the base 15 in an engaging groove 50A provided in the chassis 50, and engaging a pawl 15B provided on the base 15 in a hole 50B provided in the chassis 50 by rotating the chassis unit around the boss 15A, to provide the printer unit shown in FIG. 1. At that time, as described above, as for respective printing members disposed in the base unit and the chassis unit, the pinch roller 57 held on the base unit 15 is urged toward the conveying roller 52 by the spring, the discharging idle roller 65 is elastically urged toward the conveying roller 52, the discharging rollers 60 are urged toward the spurs 61 by the springs, and the cap 9 used for maintaining and recovering the ink discharge stability of the recording head 1 is elastically urged toward the recording head 1 mounted on the carriage 2 (not shown in FIG. 26, see FIGS. 1 and 2) at a head home position.

Accordingly, all of the printing members disposed on the chassis unit and the printing members disposed on the base unit except the above-described engaging units for combining the two units are urged by springs. Hence, positional accuracy between the units and assembling capability when connecting the units are improved.

In the above-described embodiments, urging of components by springs at the contact portion are realized using coil springs; however, plate springs, molded springs or the like may also be used. Furthermore, printing members at at least one of the units may be elastically urged.

In the foregoing embodiments, the present invention has been described illustrating a printer in which an ink-jet recording head is mounted on a carriage. However, the present invention may also be applied to an information processing apparatus which, for example, includes a scanner unit comprising a recording head having sustantially the same external shape as the ink-jet recording head that can be compatibly mounted on a carriage, and which can read image information from a sheet of an original supported on a platen.

Since the foregoing embodiments are configured as described above, the following effects can be obtained.

That is, the size and the weight of the apparatus can be reduced by providing springs at contact portions of at least one of the units so that contact portions between the printing members disposed on the chassis unit and the printing members disposed on the base unit except engaging portions for combining the two units are urged by the springs. when the two units are combined together. Furthermore, by reducing the number of components, accumulated tolerance of the entire apparatus is reduced, the generation of backlash caused by poor accuracy in positioning is thereby reduced, the feeding/discharging property, the conveying property and the capping property of the apparatus are improved, and the assembling capability is greatly improved.

By providing an elastic portion in the discharging-roller shaft, stepless adjustment of the interval between the recording head and the recording sheet can be realized.

By providing regulating members at the side of the recording surface of the recording sheet in the vicinity of the spurs, stepless adjustment of the distance between the recording sheet and the recording head can be realized and the size of the apparatus can be reduced.

By using a spur holder for slidably rotatably fixing a plurality of spurs, the number of components can be reduced, and therefore the production cost can be reduced.

The individual components shown in outline in the drawings are all well known in the recording apparatus arts and their specific construction and operation are not critical to the operation or the best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus for performing recording on a sheet member disposed in a recording region using a recording head, said apparatus comprising:

a first rotating member, disposed at a side downstream of the recording region, for conveying the sheet member while contacting a surface of the sheet member not facing the recording head;

a second rotating member for grasping the sheet member in cooperation with said first rotating member; and supporting means for supporting said first rotating member so as to be movable in a direction of approaching or separating from the recording head, said supporting means supporting said first rotating member by a shaft member having an elastically deformable portion, and transmitting a rotating driving force via the elastically deformable portion irrespective of movement of said first rotating member in the direction of approaching or separating from the recording head.

2. A recording apparatus according to claim 1, wherein the direction of approaching or separating from the recording head is a direction substantially orthogonal to the conveying direction of the sheet member.

3. A recording apparatus according to claim 1, wherein said first rotating member includes a large-diameter portion contacting said second rotating member and a small-diameter portion facing said second rotating member via a gap.

4. A recording apparatus according to claim 1, wherein said first rotating member includes a first large-diameter portion for grasping and conveying the sheet member in cooperation with said second rotating member while contacting the sheet member, a second large-diameter portion contacting the sheet member but not facing said second rotating member, and a small-diameter portion not contacting the sheet member.

5. A recording apparatus according to claim 1, wherein a non-rotating displacement regulating member for preventing displacement of a side of the sheet member facing the recording head toward the recording head is provided in the vicinity of said second rotating member.

6. A recording apparatus according to claim 1, wherein said second rotating member comprises a spur-like rotating member including a plurality of radially protruded projections.

7. A recording apparatus according to claim 1, wherein the recording head comprises an ink-jet recording head for performing recording by discharging ink from ink discharging ports.

8. A recording apparatus according to claim 1, wherein the recording head comprises an ink-jet recording head including an electrothermal transducer for generating energy for discharging ink from ink discharging ports.

9. A recording apparatus for performing recording on a sheet member disposed in a recording region using a recording head, said apparatus comprising:

first rotating members, disposed at a side downstream of the recording region, for conveying the sheet member while contacting a surface of the sheet member not facing the recording head;

second rotating members for grasping the sheet member in cooperation with said first rotating members;

third rotating members, disposed at a side downstream of said first rotating members, for conveying the sheet member while contacting the surface of the sheet member not facing the recording head;

fourth rotating members for grasping the sheet member in cooperation with said third rotating members;

first urging means for urging said first rotating members toward said second rotating members; and second urging means for urging said third rotating members toward said fourth rotating members, wherein an urging force of said second urging means is stronger than an urging force of said first urging means.

10. A recording apparatus according to claim 9, wherein the number of said first rotating members is smaller than the number of said third rotating members, and wherein the number of said second rotating members is larger than the number of said fourth rotating members.

11. A recording apparatus according to claim 9, wherein each of said second rotating members and said fourth rotating members comprises a spur-like rotating member including a plurality of radially protruded projections.

12. A recording apparatus according to claim 9, wherein the recording head comprises an ink-jet recording head for performing recording by discharging ink from ink discharging ports.

13. A recording apparatus according to claim 9, wherein the recording head comprises an ink-jet recording head including an electrothermal transducer for generating energy for discharging ink from ink discharging ports.

14. A recording apparatus for performing recording on a sheet member disposed in a recording region using a recording head, said apparatus comprising:

a first unit for holding printing members for performing image formation on the sheet member, said first unit being disposed on a side of the sheet member on which recording is not performed;

a second unit, facing said first unit, for holding printing members for performing image formation on the sheet member, the printing members of said second unit being disposed so as to be faceable at positions where they contact the printing members of said first unit when performing image formation; and urging means for urging all of the printing members of one unit toward the printing members of the other unit.

15. A recording apparatus according to claim 14, wherein the printing members for performing image formation of said first unit include a first rotating member for conveying the recording sheet, and wherein the printing members for performing image formation of said second unit include a second rotating member for grasping the sheet member in cooperation with said first rotating member.

16. A recording apparatus according to claim 14, wherein the printing members for performing image formation of said second unit include the recording head, and wherein the printing members for performing image formation of said first unit include a cap for capping the recording head.

17. A recording apparatus according to claim 14, wherein the recording head comprises an ink-jet recording head for performing recording by discharging ink from ink discharging ports.

18. A recording apparatus according to claim 14, wherein the recording head comprises an ink-jet recording head including an electrothermal transducer for generating energy for discharging ink from ink discharging ports.

* * * * *

UNITED STATES PATENT AND TRADEMARK OFFICE

CERTIFICATE OF CORRECTION

PATENT NO. : 5,847,719 Page 1 of 2

DATED : December 8, 1998

INVENTOR(S) : YAMAGUCHI ET AL.

It is certified that error appears in the above-identified patent and that said Letters Patent is hereby corrected as shown below:

Title page, item

[30] Foreign Application Priority Data:

Line 2, "Feb. 23, 1995" should read --Feb. 21, 1995--.

COLUMN 1:

Line 49, "metal;" should read --metal,--.

COLUMN 3:

Line 51, "5" should be deleted.

COLUMN 10:

Line 15, "arbitrary" should read --arbitrarily--.

COLUMN 11:

Line 66, "is" should read --are--.

COLUMN 12:

Line 48, "having" should be deleted.

Line 62, "to" should read --to be--.

UNITED STATES PATENT AND TRADEMARK OFFICE

CERTIFICATE OF CORRECTION

PATENT NO. : 5,847,719 Page 2 of 2

DATED : December 8, 1998

INVENTOR(S) : YAMAGUCHI ET AL.

It is certified that error appears in the above-indentified patent and that said Letters Patent is hereby corrected as shown below:

COLUMN 14:

Line 46, "lacks." should read --is lacking--.

COLUMN 15:

Line 26, "sustantially" should read --substantially--.

Line 38, "springs. when" should read --springs when--.

Signed and Sealed this

Twenty-fourth Day of August, 1999

*Attest:*

Q. TODD DICKINSON

*Attesting Officer*

*Acting Commissioner of Patents and Trademarks*